US011643252B2

(12) United States Patent
Barabeisch et al.

(10) Patent No.: US 11,643,252 B2
(45) Date of Patent: May 9, 2023

(54) STORAGE DEVICE

(71) Applicant: TANOS GmbH Verpacken Ordnen Präsentieren, Illertissen (DE)

(72) Inventors: Markus Barabeisch, Vöhringen (DE); Patrick Schmittmann, Giengen (DE); Rainer Snehotta, Weiβenhorn (DE)

(73) Assignee: TANOS GmbH, Illertissen (DE)

( * ) Notice: Subject to any disclaimer, the term of this patent is extended or adjusted under 35 U.S.C. 154(b) by 0 days.

(21) Appl. No.: 17/275,842

(22) PCT Filed: Sep. 14, 2018

(86) PCT No.: PCT/EP2018/074922
§ 371 (c)(1),
(2) Date: Mar. 12, 2021

(87) PCT Pub. No.: WO2020/052783
PCT Pub. Date: Mar. 19, 2020

(65) Prior Publication Data

US 2022/0041336 A1 Feb. 10, 2022

(51) Int. Cl.

| | |
|---|---|
| ***B65D 25/28*** | (2006.01) |
| ***B65D 21/02*** | (2006.01) |
| ***B25H 3/02*** | (2006.01) |

(52) U.S. Cl.
CPC ..... *B65D 25/2841* (2013.01); *B65D 21/0223* (2013.01); *B65D 25/2858* (2013.01); *B25H 3/02* (2013.01)

(58) Field of Classification Search
CPC ..... B65D 25/2835; B65D 25/2838; B65D 25/2841; B65D 2525/286; B65D 2525/288; B65D 21/0223
See application file for complete search history.

(56) References Cited

U.S. PATENT DOCUMENTS 630,886 A * 8/1899 Held ..... B65D 25/2841 16/445
4,874,088 A * 10/1989 Leben ..... G11B 23/0236 206/509
6,389,645 B1 5/2002 Polidoro
(Continued)

FOREIGN PATENT DOCUMENTS

DE 19706413 A1 8/1998
DE 102011006871 A1 7/2012
(Continued)

*Primary Examiner* — Andrew T Kirsch
(74) *Attorney, Agent, or Firm* — Hoffmann & Baron, LLP

(57) ABSTRACT

A storage device, which includes at least one storage container, which has a container housing, on the outside of which at least one handle is arranged, which is designed as a D handle having two handle legs connected to one another by a connecting web. The handle can be pivoted about a pivot axis between a non-use position pivoted against the container housing and a use position protruding away from the container housing. Two pivot bearing devices are provided for the pivot mounting, each pivot bearing device having two bearing elements inserted one in the other. A securing device is associated with each handle leg, which securing device supports the handle leg at least in such a way that the bearing elements remain mutually engaged during the use of the handle in the use position.

24 Claims, 13 Drawing Sheets

(56) References Cited

U.S. PATENT DOCUMENTS

| | | | | |
|---|---|---|---|---|
| 2003/0094392 | A1 | 5/2003 | Meier et al. | |
| 2011/0168729 | A1* | 7/2011 | Koenig | B65D 25/2858 220/768 |
| 2016/0130037 | A1 | 5/2016 | Ou | |

FOREIGN PATENT DOCUMENTS

| | | | |
|---|---|---|---|
| DE | 202012102760 | U1 | 1/2013 |
| DE | 202014103746 | U1 | 8/2014 |
| EP | 0799115 | A1 | 10/1997 |
| EP | 1752262 | A1 | 2/2007 |
| EP | 2485874 | A1 | 8/2012 |
| WO | 2011/135559 | A1 | 11/2011 |

* cited by examiner

STORAGE DEVICE

This application claims priority based on an International Application filed under the Patent Cooperation Treaty, PCT/EP2018/074922, filed on Sep. 14, 2018.

BACKGROUND OF THE INVENTION

The invention relates to a storage device with at least one storage container which comprises a container housing, on which at the outside at least one handle is arranged, said handle being designed as an at least essentially U-shaped bow grip and comprising two grip limbs which are connected to one another by a connection web, around which a hand can grip, and in the region of the free end sections of the grip limbs which are opposite the connection web being pivotably mounted on the container housing about a pivot axis via a pivot bearing device, so that it can pivoted between a position of non-use which is pivoted onto the container housing and a position of use which projects away from the container housing.

A storage device of this type which is known from DE 10 2011 006 871 A1 comprises a storage container which is designed as a hand-tool box and in whose container housing a light device is integrated. The container housing is provided with two carrier grips which can be used as handles, of which the one is an upper handle which is arranged on the upper side and the other a front handle which is arranged on a narrow front side. Both handles are designed as bow grips with an essentially U-shaped fashion and are pivotably mounted on the container housing.

DE 20 2012 102 760 U1 likewise discloses a container-like transport device which for the user-friendly handling is provided with two carrier grips for the horizontal and for the vertical carrying position.

DE 197 06 413 A1 discloses a suitcase-like receptacle which on an upper side comprises a bow-like carrier grip and to whose front side a further carrier grip can be additionally attached in a releasable manner by way of latching connection devices.

A storage device which is known from EP 2 485 874 B1 comprises a storage container whose container housing consists of a box-like housing lower part and of a housing lid which is pivotably mounted thereon in the region of the rear side. The housing lid can be pivoted into a closure position, in which it lies on the housing lower part and closes an access opening for an internal storage space of the container housing. A pivotable upper handle is attached at the outside to the upper side of the housing lid. Furthermore, coupling devices are formed in the region of the upper side and the lower side of the container housing, said coupling devices permitting the stacking of several storage containers on one another and permitting them to be releasably coupled to one another in a manner in which they cannot be lifted from one another.

SUMMARY OF THE INVENTION

It is the object of the invention to provide measures which even in the case of a heavy loading ensure a secure carrying of the storage container on a handle.

For achieving this object, according to the invention, in combination with the aforementioned features, one envisages each pivot bearing device comprising a first bearing element which is arranged on the container housing and a second bearing element which is arranged on one of the grip limbs of the handle, said bearing elements being inserted into one another in the axis direction of the pivot axis and being rotatable relative to one another with respect to the pivot axis, wherein a securing device which assumes an active state at least in the position of use of the handle is assigned to the free end section of each grip limb, by way of which securing device in its active state the assigned grip limb is supportable or supported with respect to the container housing in the axis direction of the pivot axis, in order to prevent a mutual approach of the two grip limbs which would permit a release from one another of the bearing elements which are inserted into one another.

In this manner, each of the two pivot bearing devices, via which the handle which is designed as a bow grip is pivotably mounted on the container housing, comprises two first and second bearing elements which are inserted into one another in the axis direction of the pivot axis and which are rotatable relative to one another about the pivot axis. One of these bearing elements is located on the container housing, the other on the free end section of one of the two grip limbs of the handle. In order to ensure that the pivotable handle does not inadvertently slip out of the container housing and the storage container does not fall down, even when carrying a heavily loaded storage container, a securing device which assumes an active state at least in the position of use of the handle is assigned to the free end section of each grip limb. The securing device in its active state supports the grip limb which is assigned to it, with respect to the container housing in the axis direction of the pivot axis, in a manner such that the grip limb cannot move in the direction of the other grip limb. By way of this, the bearing elements of the pivot bearing devices which are inserted into one another cannot execute an axial relative movement, by way of which they are pulled apart and separated from one another when the grip limbs of the handle are subjected to external forces which act in the sense of a mutual approach. Such external forces could arise for example if a heavily loaded storage container is lifted at the connection web of its handle and the handle elastically sags in the region of the connection web. On account of the support by way of the securing devices, one prevents the grip limbs from approaching one another due to the elastic deformation of the handle when the storage container is lifted at the connection web of its handle. Expediently, the two bearing elements are designed as one piece with the grip limbs and the first bearing elements are expediently designed as one piece with the container housing. The pivot bearing devices are preferably designed such that each second bearing element which is arranged on a grip limb, in the stick-on direction is stuck together with the first bearing element which is arranged on the container housing and which points away from the respective other grip limb in the axis direction of the pivot axis.

Advantageous further developments of the invention result from the dependent claims.

The handle, to which the two securing devices are assigned, is assembled on the container housing expediently by way of a latching procedure which is entailed by an elastic bending of the handle, concerning which the two grip limbs briefly approach one another. In order for such a latching assembly to be possible irrespective of the secured position of use, the handle can be positioned in at least one pivoting position which differs from the position of use and in which the securing devices are inactive and the grip limbs are released in a manner such that these are movable in a manner directed to one another. By way of this, a relative movement between the two grip limbs in the axis direction of the pivot axis is possible, such being necessary for the assembly procedure combined with a latching procedure.

Preferably, the handle in the at least one pivoting position which is combined with an inactive state of the securing devices can also be disassembled from the container housing again when required. A grip limb, for example assisted by an applied lever tool, then merely needs to be elastically bent to the side to such an extent that the bearing elements of a pivot bearing device disengage from one another.

Preferably, in each pivoting position, in which the securing devices are inactive, the handle can be attached to the container housing by way of latching given the first assembly of the storage container or in a case of repair. If it is the case of a releasable latching connection, which is advantageous, then the handle in the state pivoted into each of these pivoting positions can also be removed again from the container housing by way of a latching-out procedure when required.

Expediently, each securing device is designed such that its inactive state is present at least in the region of the position of non-use of the handle, wherein it is preferably exclusively present in the region of the position of non-use of the handle. The latter provides an optimal safety from inadvertently releasing the latching connection irrespectively of the pivoting position outside of the position of non-use, into which the handle is momentarily pivoted.

Expediently, the securing devices are designed such that their active state is present in the position of non-use of the handle as well as in a pivoting region of the handle of maximally 10 degrees which follows the position of non-use. In this manner, the inactive state of the securing devices is not restricted to only a very specific pivoting position for simplifying the assembly of the handle, but the pivoting region, in which the active state is present, with regard to angle is relatively small, so that the securing effect is given in a relatively large pivoting region.

Of the two bearing elements of a respective pivot bearing device of the handle, expediently the one bearing element is designed as a bearing eye and the other bearing element as a bearing pin which is rotatably inserted into the bearing eye. The bearing eyes are preferably located on the container housing and the bearing pins on the grip limbs of the handle. In this case, the bearing eyes are arranged distanced to one another in the axis direction of the pivoting axis and with insert openings which face one another. The bearing pins are likewise aligned on the handle in the axis direction of the pivot axis, but point away from one another with their free ends.

With regard to an attachment of the handle to the container housing, created by latching, it is expedient if each bearing pin at the face side has an oblique sliding surface, with which it can slide on a peripheral edging structure of the container housing which encompasses the bearing eye, whilst creating an elastic bending of the handle, when the handle given the latching procedure is moved with an assembly movement which is at right angles to the pivot axis in the direction of the container housing.

The pivot bearing devices are expediently arranged in the region of the outer sides of the two grip limbs which are away from one another in the axis direction of the pivoting axis. Hereby, there are no components of the pivot bearing devices whatsoever between the two grip limbs in the region of the U-opening.

The container housing has a housing wall which on its outer side expediently comprises a deepening which is denoted as an outer wall deepening and in which the pivotable handle is mounted. The two pivot bearing devices are preferably located in the region of two lateral edge surfaces of the outer wall deepening which lie opposite one another at a distance. The design is preferably made such that the handle is received in the outer wall deepening in a completely sunk manner in its position of non-use and projects out of the wall deepening in its position of use.

Expediently, a pivoting angle of 90 degrees is present between the position of non-use and the position of use.

Each securing device expediently has a first support projection which is arranged on the container housing in the region of the pivot axis of the handle and which projects away from the housing wall of the container housing transversely to the pivoting axis. Furthermore, a second support projection which belongs to one of the two securing devices and which participates in the pivoting movement of the handle on pivoting between the position of non-use and the position of use is arranged on the free end section of each grip limb. With each securing device, the first support projection and the second support projection are arranged offset to one another in the axis direction of the pivoting axis in a manner such that the second support projection which is arranged on the container housing is distanced further to the U-opening which is delimited between to two grip limbs, than the first support projection. The two support projections of each securing device are furthermore arranged such that in the active state of the securing device they can overlap at right angles to the pivot axis of the handle and consequently support themselves on one another in the axis direction of the pivot axis.

In order to succeed in the selective presence of the inactive state and the active state of the securing device being dependent on the pivoting position of the handle, the two support projections of each securing device are preferably designed such that in the pivoting position which defines the inactive state no overlapping at right angles to the pivot axis of the handle is present and such an overlapping is only present at those pivoting positions which correspond to an active state of the securing device. For this, for example the second support projections which are formed on the grip limbs can be designed such that they only extend a little in the circumferential direction of the pivot axis.

Expediently, the first support projection delimits a groove which is open at right angles to the pivot axis and into which the second support projection which is arranged on the handle either immerses or does not immerse depending on the pivoting position of the handle. Preferably or alternatively, the second support projection delimits a groove which is open at right angles to the pivot axis and into which the handle immerses or does not immerse depending on the pivoting position of the handle.

Expediently, an arresting device of the storage container which is designed for the non-pivotable releasable arresting of the position of non-use of the handle is assigned to the pivotable handle which is provided with the two securing devices. In this manner, the pivotable handle can be releasably arrested in the position of non-use which is pivoted onto the container housing, in a manner such that it is prevented from an uncontrolled pivoting relative to the container housing when the storage container is transported without the use of the front handle. This arresting function is particularly advantageous if the storage container yet comprises a further handle, with which it can be alternatively transported. The arresting device prevents the pivotable handle from pivoting uncontrollably to and fro and hitting the container housing at the outside when the storage container is carried whilst using the further handle. The releasable arresting ability of the position of non-use of the pivotable handle hence contributes to an improved handling comfort of the storage container.

The arresting device is preferably designed such that given a manually created pivoting of the handle it automatically changes between an active operating state which acts in an arresting manner and an inactive operating state which acts in a non-arresting manner Herewith, the arresting and the release of the arresting is effected quasi automatically when the user of the storage device grips the handle and pivots it by way of a suitable force effort in the direction of the position of non-use or in the position of use.

It is particularly in the aforementioned context that it is advantageous if the arresting device is designed as a latching device which with a snap effect automatically latches in or automatically latches out depending on the pivoting direction of the handle. Such a latching device can be inexpensively realised and can be expediently integrated into the container housing and the pivotable handle in a direct manner on manufacture of these container components.

The container housing of the storage container has an upper side which faces in a height direction as well as a front side which is orientated at right angles to the height direction. The pivotable handle which has been explained until now and to which the securing devices are assigned is preferably arranged on the front side of the container housing at the outside and can therefore be denoted as a front handle. Its pivot axis runs at right angles to the height direction of the container housing. It is suitable for a comfortable carrying of the storage container, above all when the container housing has a relatively small height in comparison to its length and width. On use of the front handle, a height axis of the container housing which determines the height direction is aligned horizontally.

The previous remarks with regard to the securing devices which ensure a secure fastening of the handle to the container housing in the position of use specifically do not apply exclusively, but in particular to a front handle.

As has already been indicated, the storage container can comprise several alternatively useable handles. In particular, the container housing additionally to the front handle which is attached to its front side comprises an upper handle which is arranged on the upper side at the outside. On using the upper handle, the storage container can be carried in an alignment, in which the height axis which defines the height direction is aligned vertically.

The upper handle in principle can be attached to the container housing in an immovable manner. However, the upper handle is also preferably pivotably mounted on the container housing and in the course of a pivoting movement can be selectively pivoted into a position of non-use which is pivoted onto the container housing at the top or into a position of use which is pivoted away from the container housing and which projects upwards Expediently, an arresting device which is suitable for the releasable arresting of the upper handle in its position of non-use is assigned to this. For an improved differentiation, the arresting device which is assigned to the front handle is denoted as the front arresting device and the arresting device which is assigned to the upper handle is denoted as an the upper arresting device.

It is advantageous if the upper arresting device and the front arresting device are designed in the same manner and operate according to the same principle. This permits a particularly inexpensive manufacture of the storage container. Both arresting devices are expediently designed as releasable arresting devices.

The upper handle in the position of non-use is expediently received in a completely sunk manner in an upper wall deepening of the container housing which is formed at the outside in the upper side of the housing wall of the container housing. This on the one hand has the advantage that the upper handle does not project beyond the outer contour of the container housing on use of the front handle as a carrier grip. On the other hand, this entails the advantage that the storage container can be stacked with further other storage containers in the height direction in a securely standing manner.

The container housing preferably has an at least essentially rectangular outline. This favours a space-saving mounting of the receiving container, in particular also in cases in which the storage device comprises several storage containers.

Preferably, the container housing is composed of a box-like housing lower part and housing lid. The housing lower part on an upper side which faces upwards in the height direction comprises an access opening for an internal storage space, to which the housing lid is assigned. The housing lid is pivotably mounted on the housing lower part in a manner such that it is selectively pivotable into a closure position which covers the access opening and into at least one open position which releases the access opening. Objects can be brought into the storage space and also be removed again, through the released access opening. The housing lower part expediently comprises a base wall and a peripheral wall which projects upwards from the edge of the base wall in the height direction of the container housing, wherein both walls belong to the housing wall of the container housing. The upper end section of the peripheral wall frames the access opening.

The upper handle is arranged on the housing lid at the top on the outside whereas the front handle is attached at the outside to the front wall of the housing part which is a constituent of the peripheral wall of the housing lower part, said peripheral wall projecting upwards from the base wall of the housing lower part.

Preferably, the container housing is designed such that the housing lid is releasably lockable to the housing lower part in the closure position. Corresponding locking means are expediently located at the outside on the front side of the container housing, in particular above the front handle in the height direction. The locking means comprise for example a rotary bar.

In an advantageous design, the storage device comprises a shelf structure, in which the at least one storage container can be received in a manner in which it can pulled out whilst not in non-use. In this context, it is advantageous if the storage container on the outer side of the container housing comprises a guide device which fits together with a counter guide device which is arranged on the shelf structure and which likewise belongs to the storage device. Preferably, the guide device as well as the counter guide device are structured in a rail-like manner and engage into one another in a linearly displaceable manner, which favours an easy pulling-out or insertion of the storage container out of and into the shelf structure respectively.

The storage device can comprise only a single storage container. However, it is advantageous if it comprises several storage containers which are preferably stackable onto one another in the height direction of each storage container. By way of this, they can be mounted in a space-saving manner.

It is advantageous if each of the several stackable storage containers comprises a lower coupling device on its container housing in the region of the lower side and an upper coupling device in the region of the upper side, wherein these two coupling devices are adapted to one another in a manner such that storage containers which are directly stacked onto one another in a height direction can be releasably coupled to one another in a manner in which they cannot be lifted from one another, by way of the interaction of the upper coupling device of the respective lower storage container and of the lower coupling device of the respective upper storage container.

If the storage containers comprise a housing lower part and a housing lid which is pivotable with respect to this, wherein these two components are releasably lockable to one another in a closure position of the housing lid by way of locking means, it is advantageous if the locking means fulfil a multi-function and are also designed as constituents of at least one of the coupling devices.

BRIEF DESCRIPTION OF THE DRAWINGS

The invention is hereinafter explained in more detail by way of the accompanying drawings. In these are shown in.

DETAILED DESCRIPTION

Figure 20:
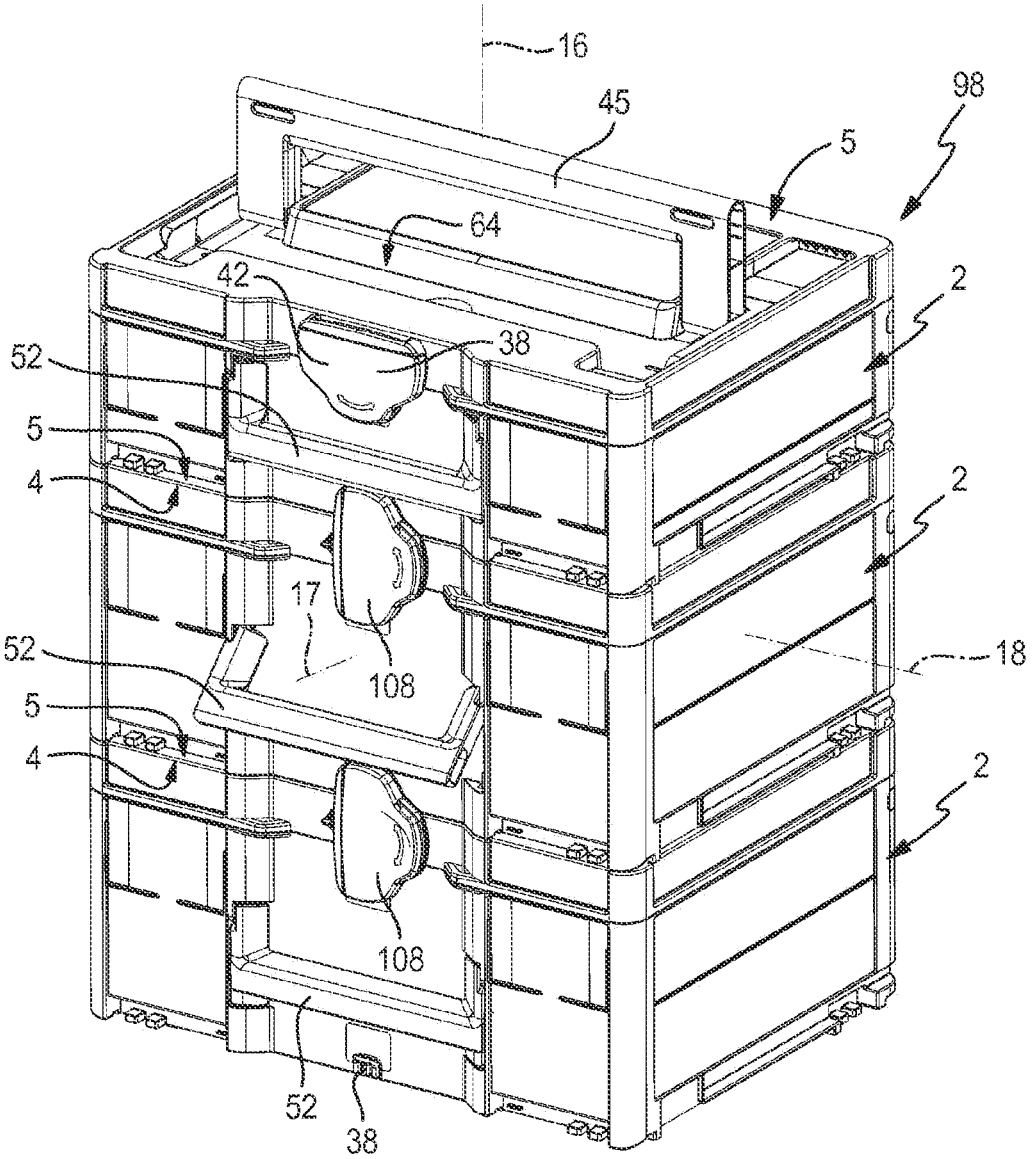

The storage device which is provided as a whole with the reference numeral 1 comprises one or more storage containers 2 whose basic construction in one advantageous design is evident from FIGS. 1 to 19. FIG. 20 shows three storage containers 2 of the storage device 1 in a state stacked upon one another whilst forming container stack 98 and these are designed identically disregarding a different height. The storage device 1 can basically also comprise only a single storage container 2.

Figure 4:
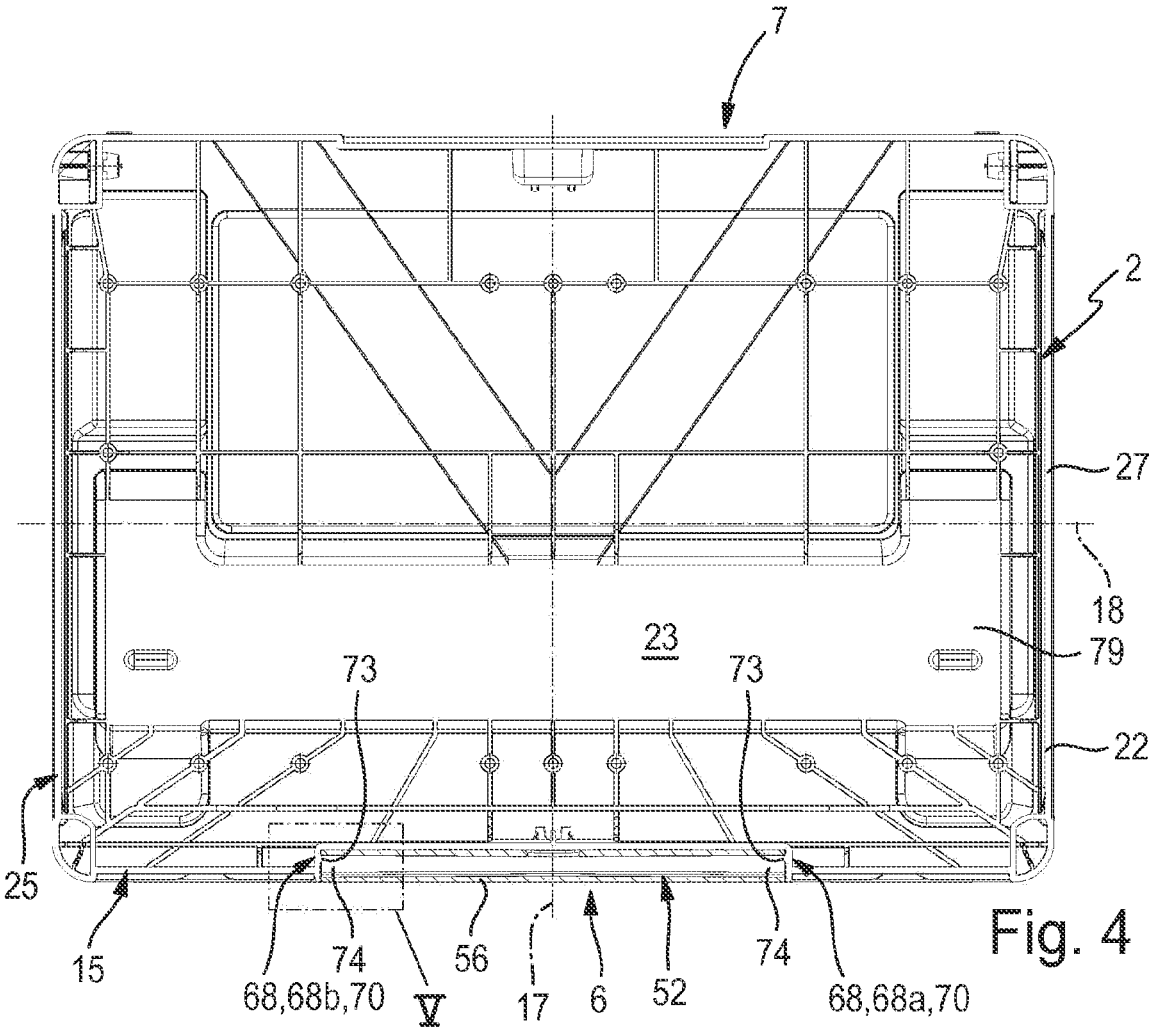
Figure 5:
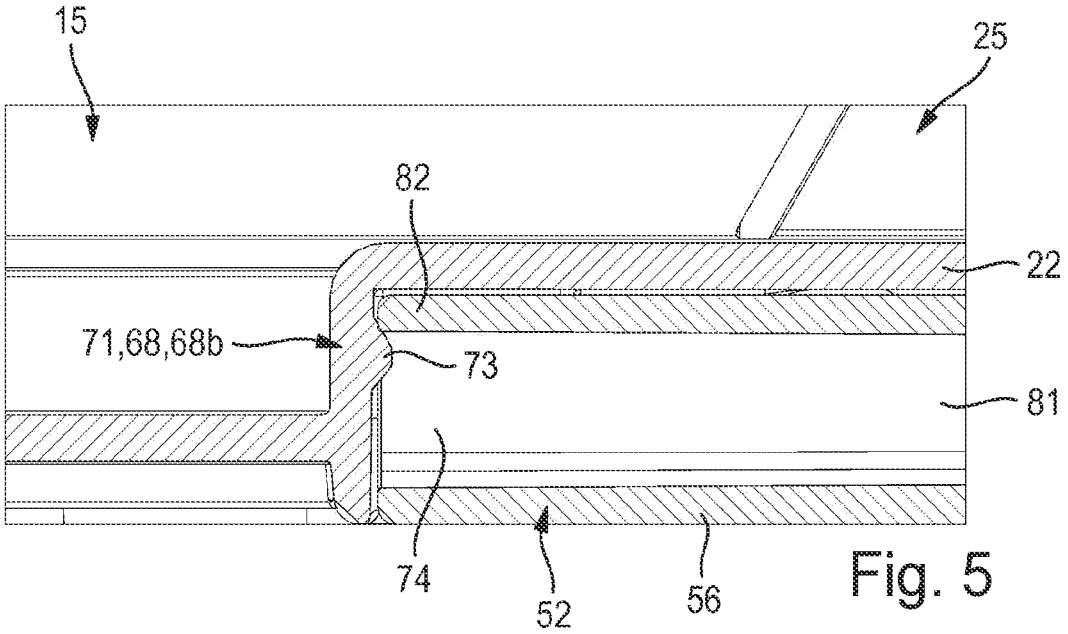
Figure 12:
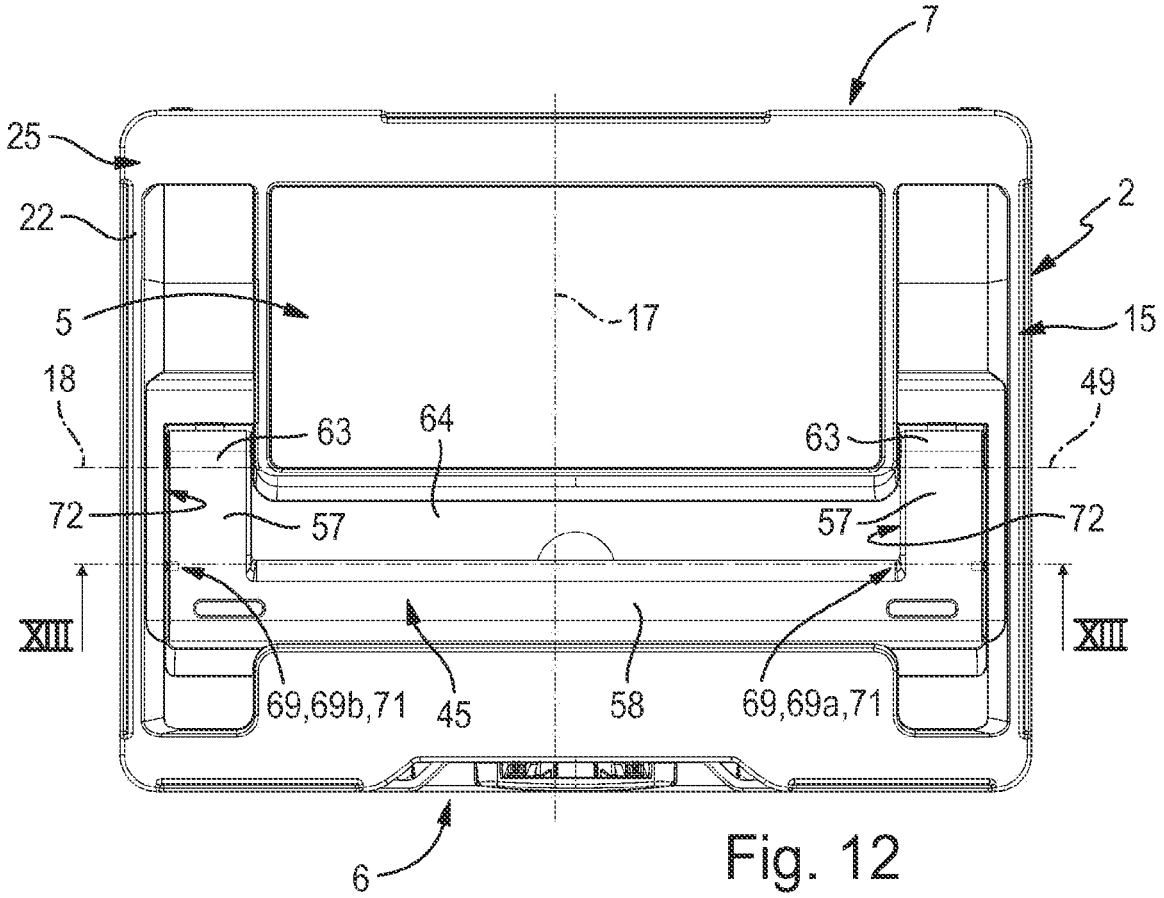

The storage container 2 has a container housing 15 with preferably an at least essentially rectangular outline which is well evident from FIGS. 4 and 12.

The container housing 15 has a height axis 16 which extends between a lower side 4 and an upper side 5 and whose axis direction defines a height direction which is provided with the same reference numerals. Furthermore, it has a longitudinal axis 17 which is at right angles to the height axis 16 and which runs between a front side 6 and a rear side 7, and furthermore has a transverse axis 18 which is at right angles to the height axis 16 as well as to the longitudinal axis 17. The axis direction of the longitudinal axis 17 defines a longitudinal direction which is provided with the same reference numeral, whereas the axis direction of the transverse axis 18 defines a transverse direction of the container housing 15 which is provided with the same reference numeral. By way of example, the dimensions in the height direction 16 define a height, the dimensions in the longitudinal direction 17 a depth and the dimensions in the transverse direction 18 a width of the container housing 15.

The aforementioned rectangular outline runs in a plane which is at right angles to the height axis 16.

Figure 6:
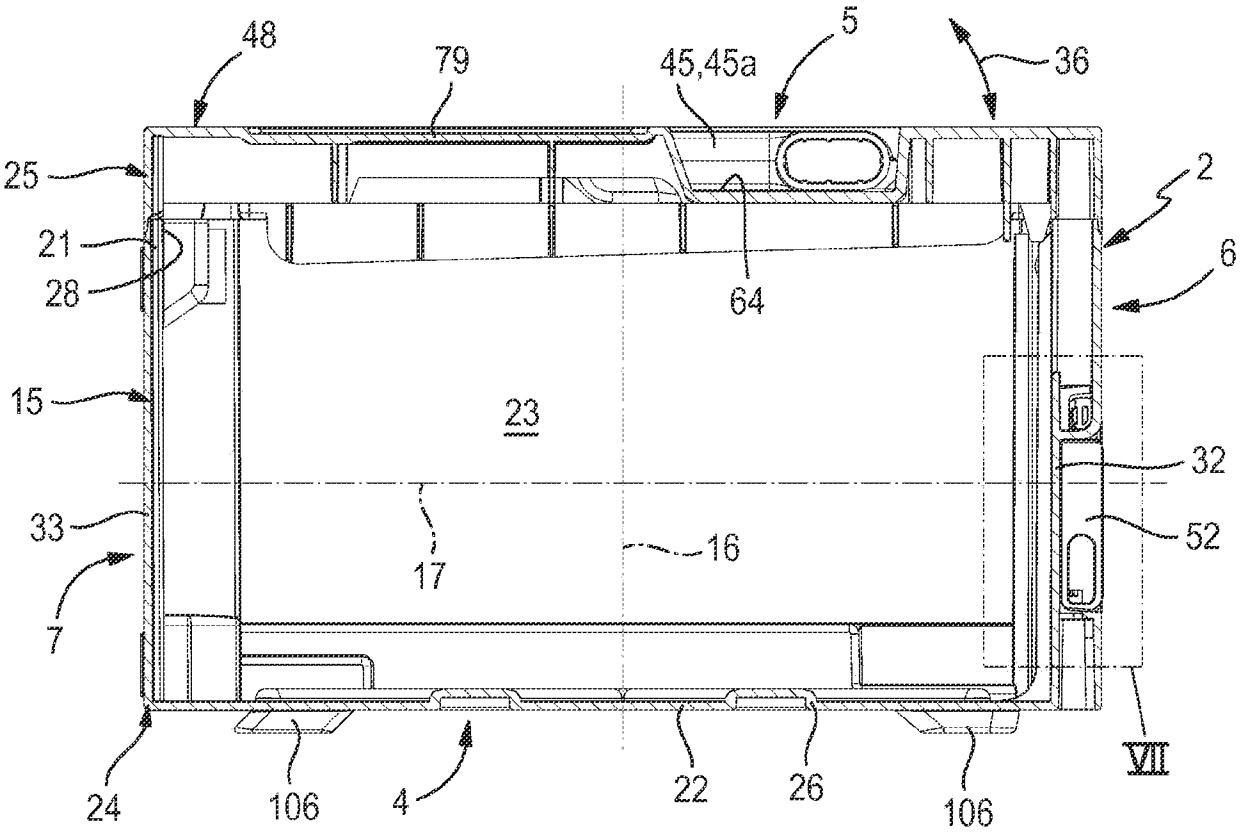
Figure 13:
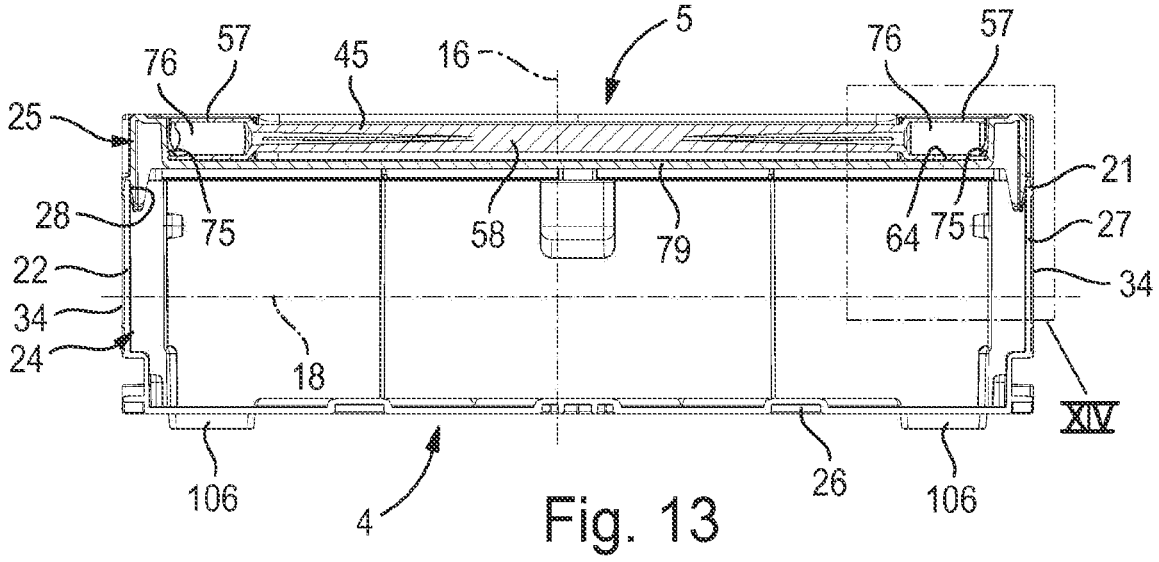
Figure 14:
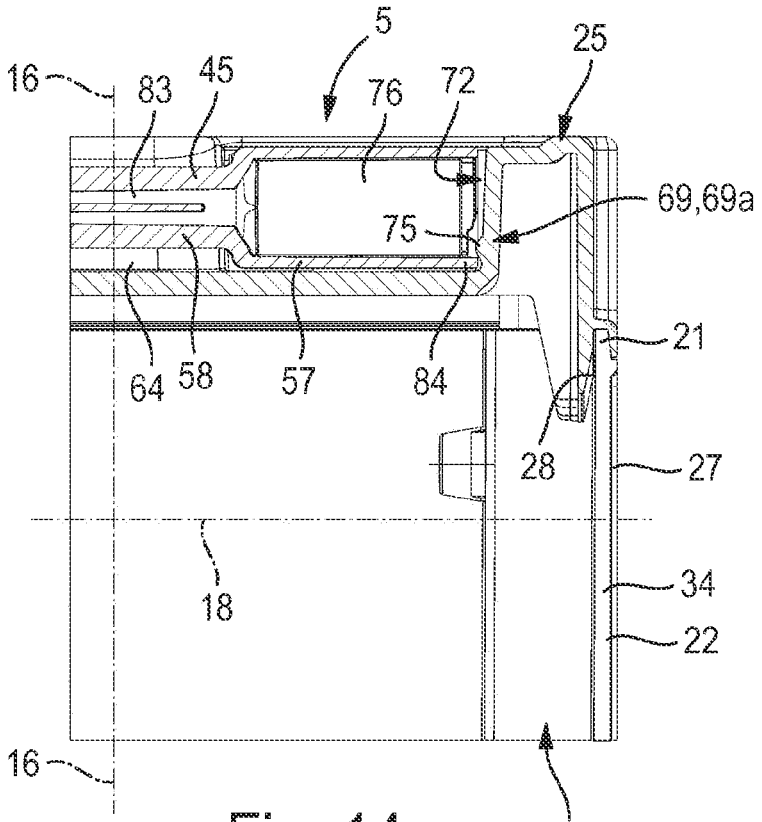

The container housing 15 has a housing wall 22 which delimits a storage space 23 which is formed in the housing interior and which is evident for example from the FIGS. 4, 6 and 13. Arbitrary objects which are to be stored, for example tools and in particular electrical tools can be accommodated in the storage space 23.

Expediently, the container housing 15 has a housing lower part 24 and a housing lid 25 which is mounted on the housing lower part 24 in a pivotably movable manner. Only the housing lid is visible in the FIGS. 9 and 11. The housing wall 22 is composed of walls of the housing lower part 24 and of the housing lid 25.

Concerning the preferably box-like housing lower part 24, the housing wall 22 consists of a base wall 26 which terminates the storage space 23 at the lower side 4 and of a peripheral wall 27 which projects upwards from the outer edge of this base wall 26 in the height direction 16. The peripheral wall 27 encompasses the storage space 23 around the height axis 16, wherein at its upper side which is opposite the base wall 26 it comprises an upper end section 21 which frames an access opening 28 for the storage space 23. Objects can be inserted into the storage space 23 and be removed from the storage space 23, through the access opening 28.

The peripheral wall 27 which is of one piece with the base wall 26 is composed of a front wall 32 which is orientated at right angles to the height axis 16, of a rear wall 33 which lies opposite the front wall 32 in the longitudinal direction 17 and of two side walls 34. The side walls 34 lie opposite one another in the transverse direction 18 and connect the front wall 32 to the rear wall 33. The front wall 32 and the rear wall 33 each extend essentially in a plane which is at right angles to the longitudinal axis 17. The side walls 34 each extend essentially in a plane which is at right angles to the transverse axis 18.

The complete peripheral wall 27 and the base wall 26 are designed as one piece with one another.

The housing lid 25 is assigned to the access opening 28 and is pivotably mounted relative to the housing lower part 24 about a pivot axis 35 which runs in the transverse direction 18, preferably in the region of the rear wall 33. Preferably, the pivot bearing means 12 which define the pivot axis 35 are arranged at the rear corner regions of the peripheral wall 27 which connect a side wall 34 to the rear wall 33, in particular at only a small height distance to the access opening 28.

Figure 1:
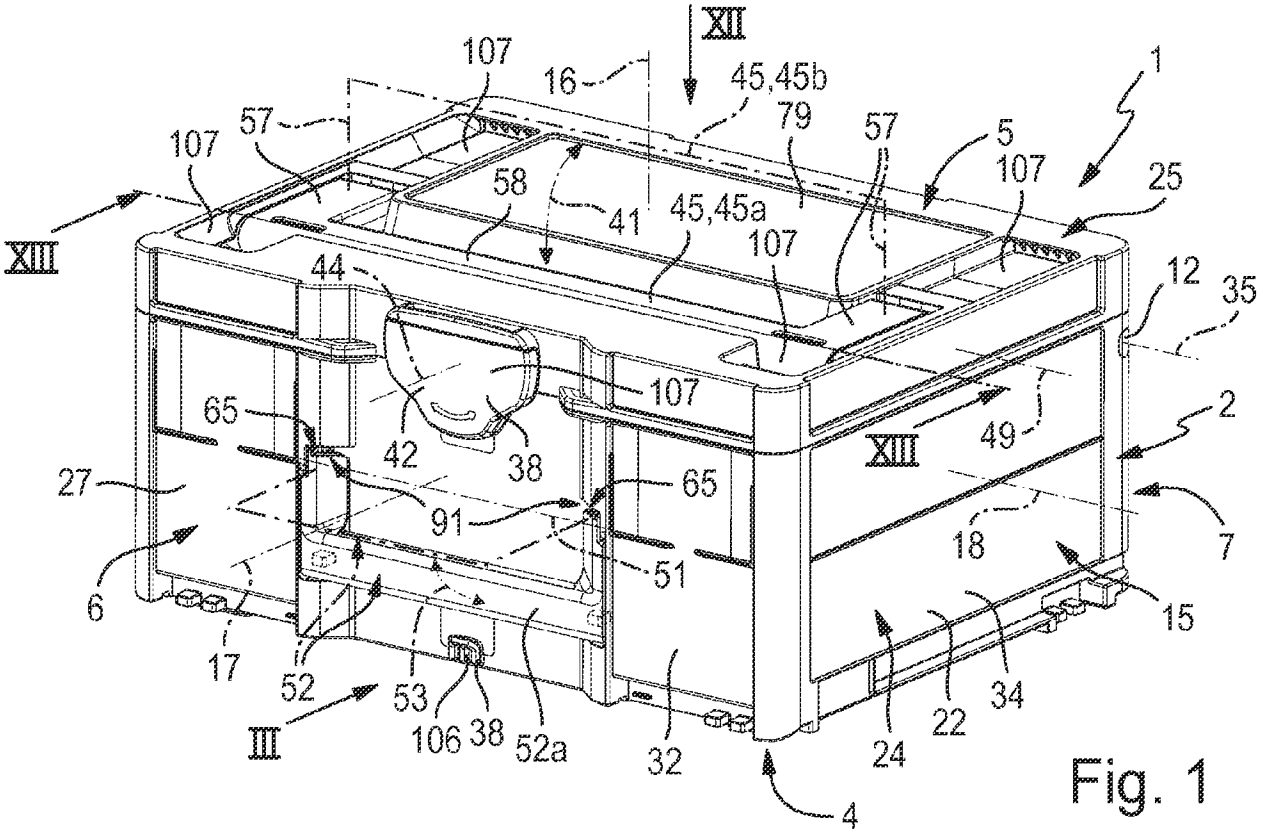
FIG. 1 a preferred first embodiment of a storage device according to the invention with a perspectively drawn storage container which is drawn with the closure position of its housing lid and which comprises two alternatively useable handles which are shown in their position of non-use, wherein its position of use is indicated in a dot-dashed manner for each handle, FIG. 2 the storage container of FIG. 1 in the state, in which its handle which is located on the front side and is designed as a front handle is pivoted into the position of use, FIG. 3 a front view of the storage container of FIG. 1 with a viewing direction according to arrow III of FIG. 1, FIG. 4 a horizontal section through the storage container with a viewing direction which is directed upwards in the direction of the housing lid according to the section plane IV-IV of FIG. 3, FIG. 5 the detail VI which is framed in a dot-dashed manner in FIG. 4, in an enlarged individual representation, FIG. 6 a vertical section of the storage container according to the section line VI-VI of FIG. 3, FIG. 7 the detail VII which is framed in a dot-dashed manner in FIG. 6, in an enlarged individual representation, wherein the front handle is shown in an arrested position of non-use, FIG. 8 the detail according to FIG. 5 given a front handle which is pivoted into the position of use, wherein a preferably present securing device assumes its active state, FIG. 9 the upper end section of the storage container from FIG. 1 in a perspective representation, wherein an upper handle which is arranged on the upper side is pivoted out of the position of non-use, so that the view onto an upper arresting device which arrests the position of non-use is cleared, FIG. 10 the detail X which is framed in a dot-dashed manner in FIG. 9, in an enlarged representation, FIG. 11 a representation which is comparable to FIG. 9, in the state of the upper handle, in which it is pivoted into the position of use, FIG. 12 a plan view of the storage container with a viewing direction according to arrow XII of FIG. 1, FIG. 13 a vertical section of the storage container according to the section plane XIII-XIII of FIGS. 1 and 12, so that two momentarily active arresting units of the upper arresting device which fixes the position of non-use of the upper handle are visible, FIG. 14 the detail XIV which is framed in a dot-dashed manner in FIG. 13, in an enlarged individual representation, FIG. 15 a further perspective representation of the storage container in the not yet assembled state of the pivotable front handle, wherein the assembly procedure is indicated by arrows, FIG. 16 the detail XVI which is framed in a dot-dashed manner in FIG. 3, on the front side of the storage container in the region of the front handle which assumes the position of non-use, wherein the front handle is only shown in a dot-dashed manner for the purpose of a better overview, FIG. 17 an individual representation of the front handle in a front view, FIG. 18 a perspective front view of the front handle, FIG. 19 a perspective rear view of the front handle, and FIG. 20 a container stack which consists of three storage containers of the storage device which are stacked upon one another and are releasably connected to one another in a vertically non-liftable manner, wherein the storage containers disregarding an different construction height are designed identically and wherein the uppermost storage container which is arranged on the container stack has a smaller construction height than the two storage containers which are placed therebelow and which amongst one another have the same construction height.
Figure 2:
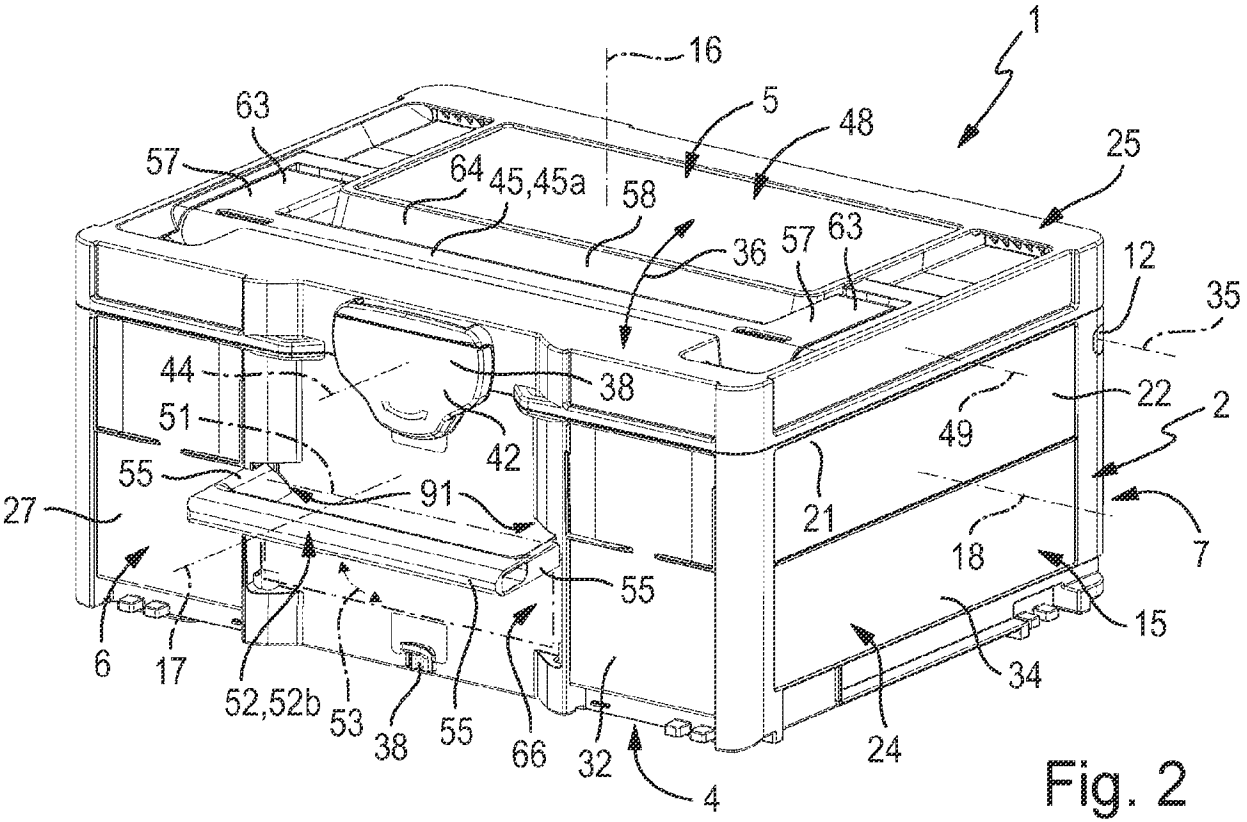

In the course of a pivoting movement 36 which is indicated in FIG. 2 by a double arrow, the housing lid 25 can be selectively positioned in a closure position which lies on the upper end section 21 of the peripheral wall 27 and herein closes the access opening 28 or in various open positions which are pivoted upwards to a greater or lesser extent. In the open positions, the access opening 28 is accessible with an opening cross section which is differently large depending on the selected opening pivoting angle.

The closure position of the housing lid 25 is expediently releasably lockable. For this, by way of example, suitable locking means 38 which can be manually actuated are to be found in the region of the front side 6 on the container housing 15 at the outside. Preferably, the locking means 38 comprise a rotary bar 42 which is rotatably mounted about a rotation axis 44 which is parallel to the longitudinal axis 17, in the region of the front side 6 on the housing lid 25, and a locking projection 43 which is arranged at the outside on the front wall 32 of the housing lower part 24. In the state of the housing lid 25, in which it is located in the closure position, the rotary bar 42 can be rotated such that it is selectively in or out of locking engagement with the assigned locking projection 43.

The storage container 2 which is illustrated by way of example comprises only a single storage space 23 which is closed by the housing lid 25 in a manner which is to be opened. Concerning an embodiment example which is not illustrated, additionally yet at least one drawer which when required can be pulled out and which provides an additional storage space is yet additionally arranged in the housing lower part 24. Concerning an embodiment example which is likewise not shown, the container housing 15 on the upper side 5 has no cover, but a cover wall which is designed as one piece with the peripheral wall 27, wherein the storage container 2 as a whole is designed as a drawer container which comprises one or more drawers which when required can be pulled out of the container housing or pushed into it and whose drawer spaces together define the storage space 23.

A handle 52 which for an improved differentiation is denoted as a front handle 52 is arranged on the container housing 15, at least at the outside on the front side 6. If the container housing 15 is composed of a housing lower part 24 and of a housing lid 25 in accordance with the embodiment example, then the front handle 52 is preferably attached at the outside to the front wall 32 of the housing lower part 24. This is the case with regard to the illustrated embodiment example. By way of using the front handle 52, the storage container 2 can be carried and transported in an alignment, in which the height axis 16 is aligned horizontally and which is hereinafter denoted as a vertical alignment.

The storage container 2 at the outside on its upper side 5 which is oriented in the height direction 16 preferably comprises a further handle 45 which for an improved differentiation is denoted as an upper handle 45. If the container housing 15 according to the embodiment example comprises a housing lid 25, then the upper handle 45 is attached at the outside to an upper lid wall 79 of the housing lid 25 which in the closure position extends at right angles to the height axis 16. By way of using the upper handle 45, the storage container 2 can be carried and transported in a horizontal alignment, in which the height axis 16 runs vertically.

At least the front handle 52, preferably however also the upper handle 45 are pivotably mounted on the container housing 15, so that by way of pivoting relative to the container housing 15 they can be selectively positioned in a position of non-use which is pivoted onto the container housing 15 or in a position of use which projects away from the container housing 15.

The pivot axis 51 of the front handle 52 is hereinafter denoted as a front pivot axis 51, wherein the associated pivoting movement 53 is rendered evident by a double arrow.

The pivot axis 49 of the upper handle 45 is hereinafter denoted as the upper pivot axis 49 wherein the associated pivoting movement 41 is likewise indicated by a double arrow.

Both pivot axes 51, 49 run parallel to the transverse axis 18.

The positions of non-use of the two handles 52, 45 which are pivoted onto the container housing 15 are shown at 52*a* and 45*a*, the positions of use at 52*b* and 45*b*. The front handle 52 in its position of use 52*b* projects to the front away from the container housing 15, wherein the upper handle 45 in its position of use 45*b* projects away upwards from the container housing 15.

Preferably, the front handle 52 is designed as a bow grip which is designed at least essentially in a U-shaped manner. This also applies to the upper handle 45. Both handles 52, 45 are realised as bow grips in the illustrated embodiment example.

The front handle 52 which is designed as a bow grip has two grip limbs 55 which correspond to the U-limbs and which are distanced to one another in a grip longitudinal direction 45 and are parallel to one another and which at their one face-side end region are connected to one another by way of a connection web 56. The grip longitudinal direction 54 runs in an axis direction of a longitudinal axis of the front handle 52, said longitudinal axis being provided with the same reference numeral.

The upper handle 45 in a corresponding manner likewise has two grip limbs 57 which are distanced to one another in the longitudinal direction 18 and which are connected to one another at one end by way of a connection web 58.

The preferably rod-like connection webs 56, 58 of the two handles 52, 54 expediently run parallel to one another. The upper handle 45 preferably has a greater length than the front handle 52. Both handles 52, 45 are arranged and designed mirror-symmetrically with respect to a middle plane which is spanned by the height axis 16 and the longitudinal axis 17 and which passes through the container housing 15 at the centre of the width.

The upper handle 45 is pivotably mounted on the housing lid 25 in the region of the free end sections 63 of its grip limbs 57 which are opposite to its connection web 58. In the position of non-use 45*a*, a grip plane of the upper handle 45 which is spanned by the connection web 58 and the two grip limbs 57 runs at right angles to the height axis 16.

Preferably, the upper lid wall 79 of the housing lid 25 which belongs to the housing wall 22, at the outside comprises an upper wall deepening 64, in which the upper handle 45 is rotatably mounted and in which the upper handle 45 is received in a preferably completely sunk manner on assuming its position of non-use 45*a*. The upper wall deepening 64 is expediently likewise designed in a U-shaped manner. In the position of use 45*b*, the upper handle 45 projects upwards out of the upper wall deepening 64, wherein the connection web 58 is distanced sufficiently far to the upper lid terminating surface 48, in order to permit the gripping around by way of a hand for carrying the storage container 2.

Alternatively to the pivotable upper handle 45, the storage container 2 can however also comprise an upper handle 45 which is fixedly attached to the container housing 15 in a non-pivotable manner.

The front handle 52 in the region of the free end sections 62 of its grip limb 55 which are opposite to its connection web 56 are pivotably mounted on the front wall 32 at the outside for executing the pivoting movement 53. For the definition of the assigned front pivot axis 51, a suitable pivot bearing device 65 is assigned to each free end section 62 of the two grip limbs 55.

The front wall 32 at its outer side which is away from the storage space 32 is expediently provided with a front wall deepening 66, in which the two pivot bearing devices 65 are arranged. The front wall deepening 66 has such a depth that the front handle 52 is completely sunk therein given the assumption of its position of non-use 52*a*. In the position of use 52*b*, the front handle 52 projects significantly far out of the front wall deepening 66, in order to be able to grip around the connection web 56 with one hand for carrying the storage container 2.

A handle plane which is spanned by the two grip limbs 55 and the connection web 56 of the front handle 52, in the position of non-use runs at right angles to a longitudinal axis 17 and in the position of use at right angles to the height axis 16.

The front wall recess 66 at its two sides which are distanced to one another in the transverse direction 18 are delimited by two lateral edge surfaces 67 which face one another and are distanced to one another in the transverse direction 18. Each pivot bearing device 65 is preferably placed in the region of one of these two lateral edge surfaces 67.

The front handle 52 is expediently pivoted downwards in the position of non-use 45*a*, which is to say its U-opening points upwards in the height direction 15.

Concerning the upper handle 45, the position of non-use 45*a* expediently manifests itself in the fact that the U-opening of the bow-shaped upper handle 45 faces the rear side 7 in the longitudinal direction 17.

Expediently, an arresting device of the storage container 2 which is denoted as a front arresting device 68 for an improved differentiation is assigned to the front handle 52 and is designed for the non-pivotable releasable arresting of the front handle 52 in its position of non-use 52*a*.

It is advantageous if an arresting device which is suitable for the releasable arresting of the position of non-use 45*a* of the upper handle 45 is assigned to this, said arresting device being denoted as an upper arresting device 69 for an improved differentiation. The storage container 2 of the illustrated embodiment example comprises the front arresting device 68 as well as the upper arresting device 69.

Each arresting device 68, 69 prevents the handle 52, 45 which is situated in the position of non-use 52*a*, 45*a* from carrying out uncontrolled pivoting movements relative to the container housing 15 when the storage container 2 is transported whilst using the respective other handle 45 or 52 which is momentarily in the position of use 45*b*, 52*b*.

The front arresting device 68 is expediently designed as a latching device 70 which depending on the pivoting direction of the pivoting movement 53 automatically latches in or latches out with a snap effect when a corresponding actuation force is introduced into the front handle 52. The intensity of the latching is adequately large, in order to prevent an automatic latching-in or latching-out given the designated handling of the storage container 2. However, it is sufficiently small, in order to be able to create a latching or a lifting of the latching solely by way of action by hand without an extraordinary force application.

The upper arresting device 69 is preferably likewise designed as a latching device 71 whose functional characteristics correspond to the aforementioned ones which are explained by way of the latching device 70.

Basically, it is possible for the front and/or the upper arresting device 68, 69 to be designed in a manner in which they are to be actuated separately, so that a mere manual force introduction into the assigned handle 52, 45 does not alone cause a change of the operating state. For example, at least one spring-loaded bar can be present. The outlined design with an automatic blocking and de-blocking alone on account of a suitable force introduction into the assigned handle 52, 45 however permits a particularly comfortable handling given simultaneously low manufacturing costs.

The operating state which is assumed by the arresting device 68, 69 given a non-pivotably arrested position of non-use 45*a*, 52*a* is hereinafter also denoted as an active operating state. That operating state of the arresting device 68, 69 which no longer arrests the position of non-use is hereinafter also denoted as an inactive operating state.

The pivoting angle of the front handle 52 and/or of the upper handle 45 between the position of non-use 52*a*, 45*a* and the position of use 52*a*, 45*b* is expediently at least essentially 90 degrees. Each handle 52, 45 can be pivoted within this pivoting range, in particular in an infinite manner, into arbitrary intermediate positions which are all neither arrested nor arrestable. In FIG. 20, such an intermediate pivoting position of the front handle 52 is shown at the middle container 2. As soon as the handle 52, 45 has left the arrested position of non-use 52, 45*a*, it can be freely pivoted at least to into the position of use 52*b*, 45*b*. Given a suitable design of the pivot bearing means, the handle 52, 45 can even be pivoted beyond the position of use 52*b*, 45*b*.

The arresting device 68, 69 can be locally limited to a single region of the respective handle 52, 45. However, it is seen as more advantageous if the front arresting device 68 and/or the upper arresting device 69 consists of several, in particular of precisely two arresting devices 68, 68*b*; 69*a*, 69*b* which are locally arranged distanced to one another. By way of example, the two arresting units 68*a*, 68*b* and 69*a*, 69*b* of each arresting device 68, 69 are distanced to one another in the axis direction of the assigned pivot axis 51, 49.

The two arresting units 68*a*, 68*b* of the front arresting device 68 which are hereinafter also denoted as front arresting units 68*a*, 68*b* for simplification are each arranged in the region of one of the two grip limbs 55. They are preferably each located in the region of one of the two lateral edge surfaces 67 of the front wall deepening 66.

The front arresting units 68*a*, 68*b* are arranged distanced to the pivot bearing devices 65 transversely to the pivot axis 51. In particular, they are located at a distance to the pivot axis 51, which corresponds to the distance of the connection web 56 to the pivot axis 51. Considered in the position of non-use 52*a* of the front handle 52, both front arresting units 68*a*, 68*b* expediently lie in the region of the connection web 56.

The arresting units 69*a*, 69*b* of the upper arresting device 69 which are hereinafter also denoted as upper arresting units 69*a*, 69*b* are arranged with respect to the upper handle 45 in a comparable manner as the front arresting units 68*a*, 68*b* are arranged with respect to the front handle 52. In each case, one of the upper arresting units 69*a*, 69*b* is located in the region of one of the grip limbs 57, in particular in its region which is away from the respective other grip limb 57. They are each located in the region of one of two lateral edge surfaces 72 of the upper wall deepening 66 which face one another and which are arranged distanced to one another in the transverse direction 18 and with the embodiment example each lie in the proximity of one of the two side walls 34. In the position of non-use 45*a*, one of the grip limbs 57 of the upper handle 45 extends next to each of these two lateral edge surfaces 72. The upper arresting units 69*a*, 69*b* are preferably each arranged in the region of the connection web 58 of the upper handle 45.

Preferably, each front arresting unit 68*a*, 68*b* comprises an arresting projection 73 which by way of example is designed in a pimple-like manner and is arranged on the housing wall 22 of the container housing 15 and in particular is designed as one piece with the housing wall 22. It represents a first arresting element 73*a* of the front arresting unit 68*a*, 68*b*. Each arresting projection 73 is preferably formed on one of the two lateral edge surfaces 67 of the front wall deepening 66, so that it projects from the side into the front wall deepening 66.

Expediently, each upper arresting unit 69*a*, 69*b* also comprises a correspondingly designed arresting projection 75, wherein these arresting projections 75 are expediently each formed on one of the two lateral edge surfaces 72 of the upper wall deepening 66.

Each arresting projection 73 of the front arresting units 68*a*, 68*b* in the position of non-use 52*a* engages into an arresting deepening 74 of the respective front arresting unit 68*a*, 68*b* which is formed in the front handle 52. This arresting deepening 74 represents a second arresting element 74*a* of the respective front arresting unit 68*a*, 68*b*.

In an advantageous manner, the two arresting deepenings 74 with regard to the embodiment example are formed by the end regions of a cavity 81 which passes through the connection web 56 in its longitudinal direction, said end regions being assigned to the two grip limbs 55. In the position of non-use 52, each arresting projection 73 immerses from a face side into the cavity 81 and engages behind a wall section 82 of the connection web 56 which peripherally encompasses this cavity 81. This is well evident in FIG. 7. The wall section 82 can be moved past the arresting projections 73 with a snap effect by way of the pivoting movement 53 of the front handle 52.

In a comparable manner, each upper arresting unit 69*a*, 69*b* also expediently comprises an arresting deepening 76 which is formed on the upper handle 45 and by one of the two opposite end regions of a cavity 83, said cavity longitudinally passing through the connection web 58 of the upper handle 45. In the position of non-use 45*a*, the two arresting projections 75 engage into the cavity 83 from opposite sides and overlap a wall section 84 of the connection web 58 which peripherally encompasses the cavity 81. Given the pivoting moment 41 of the upper handle 45, the mentioned wall section 84 can be moved past the assigned arresting projection 75 with a snap effect.

It is to be understood that the assignment of the arresting projections 73, 75 and of the arresting deepenings 74, 76 with respect to the container housing 15 and the respective handle 52, 45 can also be exchanged.

Each arresting deepening 74, 76 is designed complementarily to the shape of the arresting projection 73, 75 in the case of an embodiment example which is not illustrated, and has the shape for example of a small trough, into which the pimple-like arresting projection 73, 75 can snap.

It is to be understood that the first and the second arresting element 73*a*, 74*a* of the front handle 52 can also be designed in a manner other than in the form of an arresting deepening and an arresting projection. The same also applies to the constituents of the upper arresting unit 69*a*, 69*b*.

As a whole, it is advantageous if the upper arresting device 69 is designed in the same manner as the front arresting device 68, this being is realised with the illustrated embodiment example.

A particularly advantageous design of the fastening measures for the front handle 52, said measures permitting a pivoting movement 53, are explained hereinafter.

As already mentioned, the pivotable fixation of the front handle 52 to the front wall 32 is effected by way of two pivot bearing devices 65 which are each assigned to one of the free end sections 62 of the grip limbs 55.

Each of these pivot bearing devices 65 has a first bearing element 85 which is arranged on the container housing 15 and a second bearing element 86 which is arranged on the grip limb 55. These two bearing elements 85, 86 are stuck into one another in the axis direction of the pivot axis 51 and are rotatable relative to one another.

Preferably, the pivot bearing devices 65 are designed such that each second bearing element 86 which is arranged on a grip limb 55 is stuck together in a stick-on direction with the first bearing element 85 which is arranged on the container housing 15 and which in the axis direction of the pivot axis 51 points away from the respective other grip limb 55.

Expediently, the second bearing elements 86 are designed as one piece with the grip limbs and the first bearing elements 85 are expediently designed as one piece with the container housing 15.

By way of example, the first bearing element 85 is designed as a bearing eye 85*a* which comprises an insert opening 87 which faces the adjacent grip limb 57. The bearing eye 85*a* in particular is realised as a wall deepening or a wall recess of the front wall 32. With the embodiment example, it is formed in each one of the two lateral edge surfaces 67 of the front wall deepening 66. The two insert openings 87 face one another and are aligned coaxially to one another.

The second bearing element 86 which is arranged on the front handle 52, with regard to the embodiment example is designed as a bearing pin 86*a* which immerses through the insert opening 86 into the assigned bearing eye 85*a*. The two bearing pins 86*a* are also aligned coaxially to one another, wherein they point in directions which are opposite to one another, thus away from one another. In particular, they are located on the outer sides of the two grip limbs 55 which are away from one another. Hence each bearing pin 86*a* immerses from the front wall deepening 66 into the assigned bearing eye 85*a*.

The pivot bearing devices 65 are consequently preferably arranged in the region of the outer sides of the two grip limbs 55 of the front handle 52, said outer sides being away from one another in the axis direction of the pivot axis 51.

Figure 8:
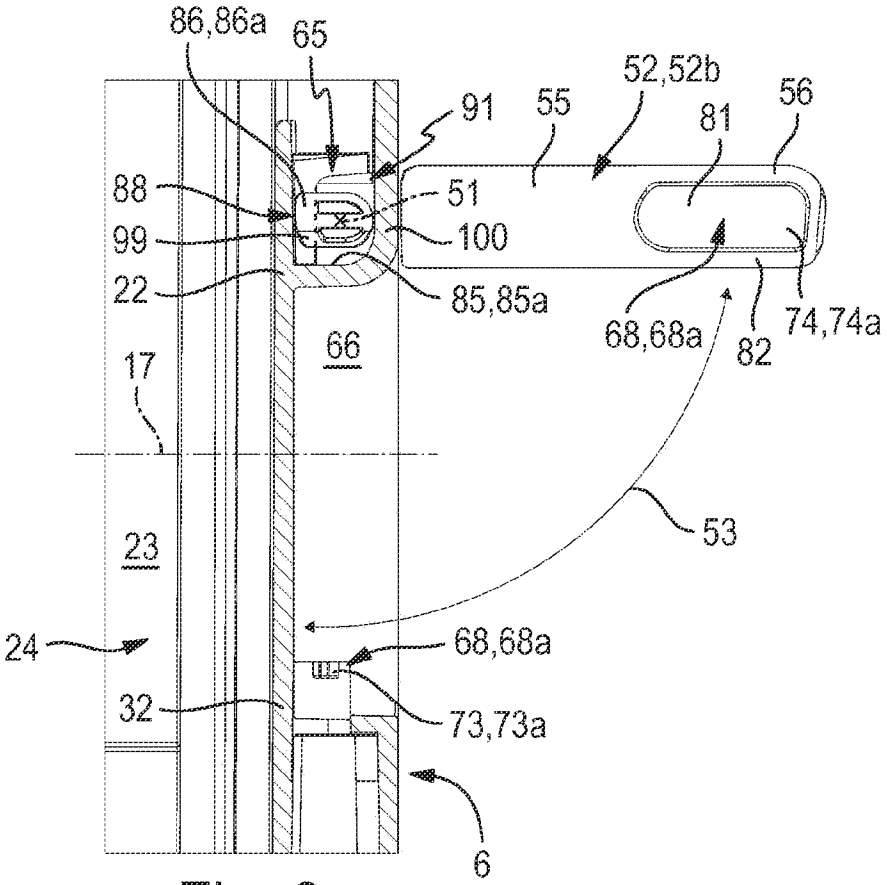
Figure 7:
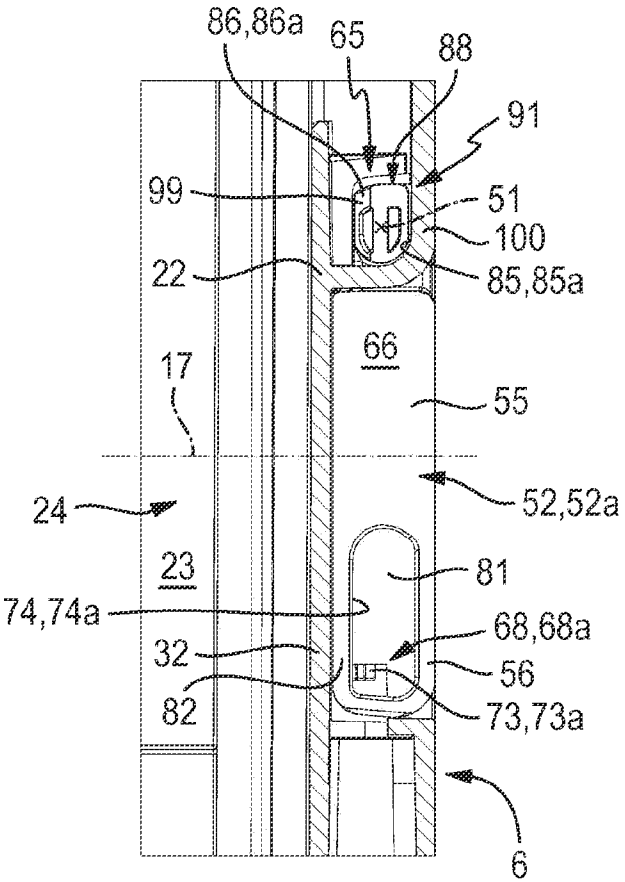
Figure 10:
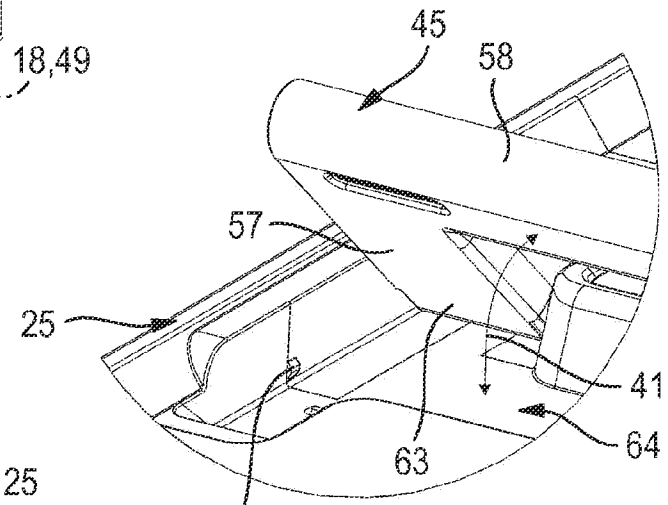
Figure 9:
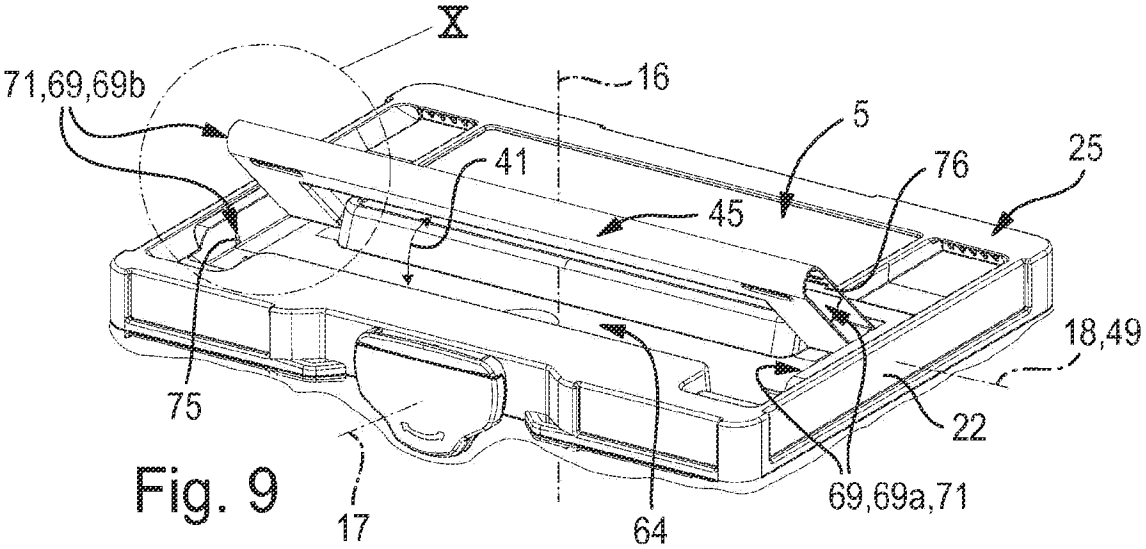
Figure 11:
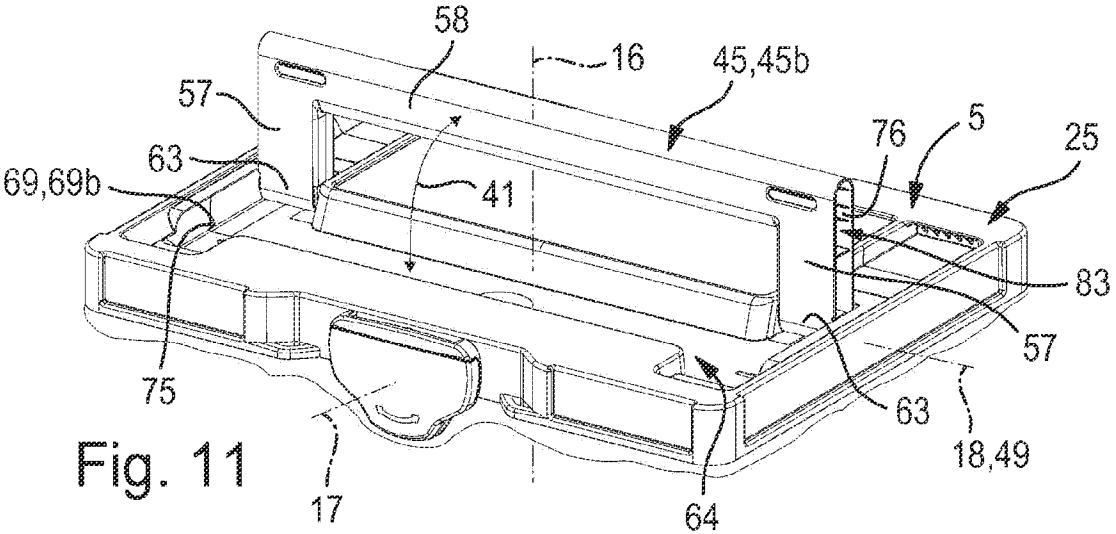

As is particularly well evident from FIGS. 7, 8 and 9, the bearing pins 86*a* by way of example have a non-round cross-sectional contour. However, they can indeed also be designed in a circularly round manner.

It is to be understood that the arrangement of the bearing eyes 85*a* and bearing pins 86*a* with respect to the container housing 15 and the front handle 52 can also be exchanged.

By way of a non-round cross-sectional contour of the bearing pins 86*a*, it is very simple to realise the front handle 52 being able to be non-pivotably fixed in the position of use 52 in a simply releasable manner by way of a positive contact with the housing wall 22. By way of example, the bearing pin 86*a* at a location of its peripheral periphery comprises a flattening 88 which in the position of use 52*b* bears and is supported on a plane wall surface of the housing wall 22. Since the individual constituents consist of a plastic material, they are mutually compliant when a torque is exerted onto the front handle 52. Inasmuch as this is concerned, the position of use 52*b* which is fixed by way of the bearing pins 86*a* can be very easily lifted again.

The front handle 52 expediently consists of a plastic material. This preferably also applies to the upper handle 45 and to the complete container housing 15.

If the storage container 2 is carried in the vertical alignment by way of the front handle 52, then the front handle 52 has the tendency to bend in the sense of a mutual approach of the two grip limbs 55. These bending forces are indicated at 90 by arrows in FIG. 3. If the front handle 52 is not designed in a particularly stable manner, then this in principle could result in the bearing pins 86*a* slipping out of the bearing eyes 85*a* and the container housing 15 detaching. This danger is particular high given a heavy loading of the storage space 23.

Concerning the illustrated storage container 2, securing measures are undertaken to rule out this potential danger despite the lightweight construction manner of the front handle 52. Hence the front handle 52 can be manufactured in a cost-saving manner, wherein in particular there exists the possibility, which is implemented in the embodiment example, of designing the connection web 56 in a tubular manner as a hollow body.

The securing measures lie in a securing device 91 which is arranged on the storage container 2 being assigned to the free end section 62 of each grip limb 55. Each securing device 91 is designed such that at least in the position of use of the front handle 51 it assumes an active state, in which it can support or supports the assigned grip limb 55 in the axis direction of the pivot axis 51 with respect to the container housing 15, in order, given the occurrence of bending forces 90, to prevent a mutual approach of the two grip limbs 55 and thus a release of the bearing elements 85, 86 which are stuck into one another, from one another.

In an exemplarily realised embodiment, each securing device 91 comprises a first support projection 92 which is fixedly arranged on the container housing 15 in the region of the pivot axis 51 and which projects away from the front wall 32 to the front side 6 transversely and in particular at right angles to the pivot axis 51. Each securing device 91 further comprises a second support projection 93 which is arranged at the free end region 62 of the assigned grip limb 55 and which in the axis direction of the pivot axis 91 is arranged offset to the first support projection 92 and specifically offset in the direction of the outer side of the assigned grip limb 55 which is away from the respective other grip limb 55. The clear distance of the first support projections 92 which are arranged on the container housing 15, measured in the transverse direction 18 is therefore smaller than the clear distance between two second support projections 93 which are formed on the front handle 52, measured in the grip longitudinal direction 54.

Each second support projection 93 participates in the pivoting movement 53 of the front handle 52 and is designed such that it overlaps the adjacent first support projection 92 which is arranged on the front wall 32 of the container housing 15, at right angles to the pivot axis 51, at least during the active state of the securing device 91. By way of this overlapping, the second support projection 93 can support itself with an inner support surface 94 which is formed on its end-face which faces the U-opening of the bow-like front handle 52, on an oppositely orientated outer support surface 95 of the first support projection 92 which faces it.

The securing devices 91 can thus be designed such that the active state is present in every pivoting position of the front handle 52.

It is above all in the context of a particularly favourable assembly possibility for the front handle 52 that it is however advantageous if the securing devices 91 develop their effect in a selective manner, specifically in a manner depending on the pivoting angle of the front handle 52 which is assumed with respect to the container housing 15. Hence with regard to the embodiment example, each securing device 91 in at least one other pivoting position which differs from the position of use 52 of the front handle 52 has an inactive state, in which it releases the assigned grip limb 55 for a relative movement which is directed to one another, between the two grip limbs 55 in the axis direction of the pivot axis 51. Hence the two grip limbs 55 in the inactive state of the securing devices 91 can be approached to one another in the direction of the arrows 90 in FIG. 3 amid the elastic bending of the front handle 52, in particular of its connection web 56.

By way of example, this selective effect of the securing devices 91 is achieved by a special design of the second support projections 93 which are arranged on the grip limbs 55. These support projections have only a limited circumferential extension around the pivot axis 51, wherein their circumferential extension is about 90 degrees with the embodiment example. The support projections 93 therefore only assume a position which overlaps with the first support projections 92 in the active state of the securing devices 91 (FIG. 8), whereas this overlapping is lifted in other pivoting positions of the front handle 56 (FIG. 7).

It is advantageous if the inactive state of the securing device 91 is exclusively present when the front handle 52 is positioned in the region of the position of non-use 52*a*, or in a restricted pivoting range of the handle of maximal 10 degrees starting from the position of non-use 52*a*, wherein the position of non-use 52*a* is included. Such a design is present with the embodiment example.

The design with a selective action of the securing device 91 provides the opportunity which is utilised in the illustrated embodiment example, of assembling the front handle 52 on the container housing 15 and preferably of also disassembling it again, by way of a latching procedure whilst simultaneously ensuring the securing function on carrying the storage container 2 by way of the front handle 52.

Figure 15:
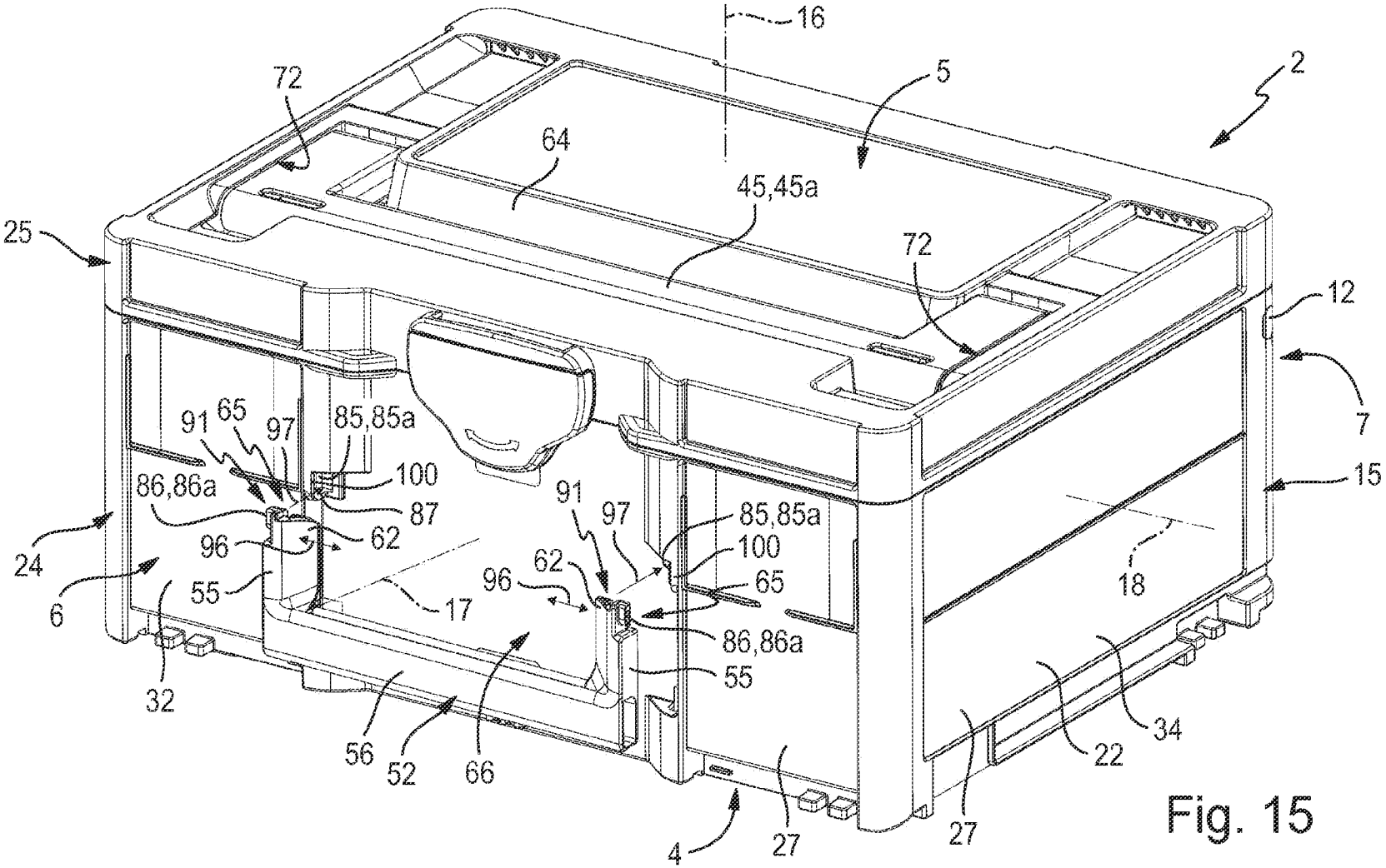
Figure 16:
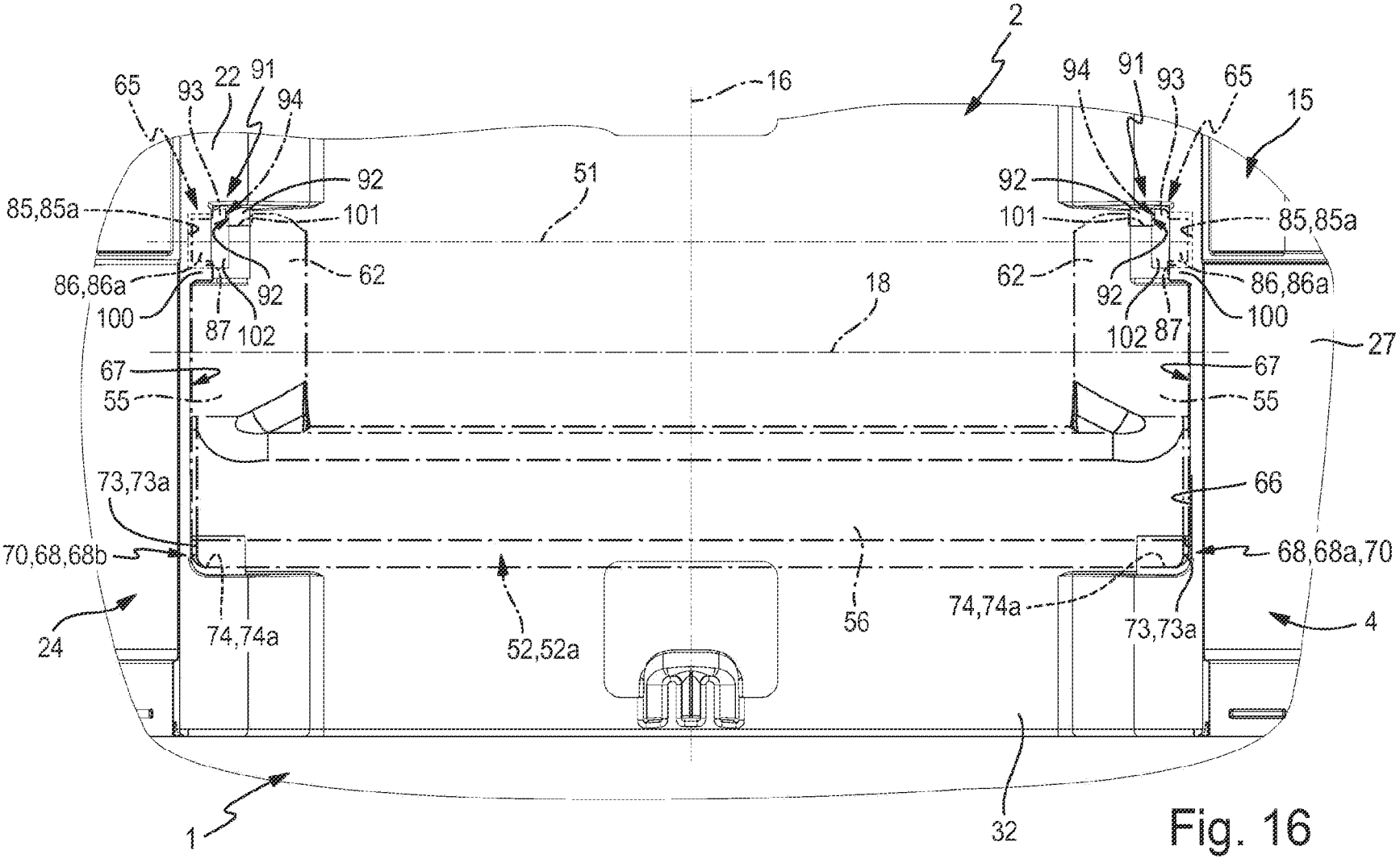
Figure 17:
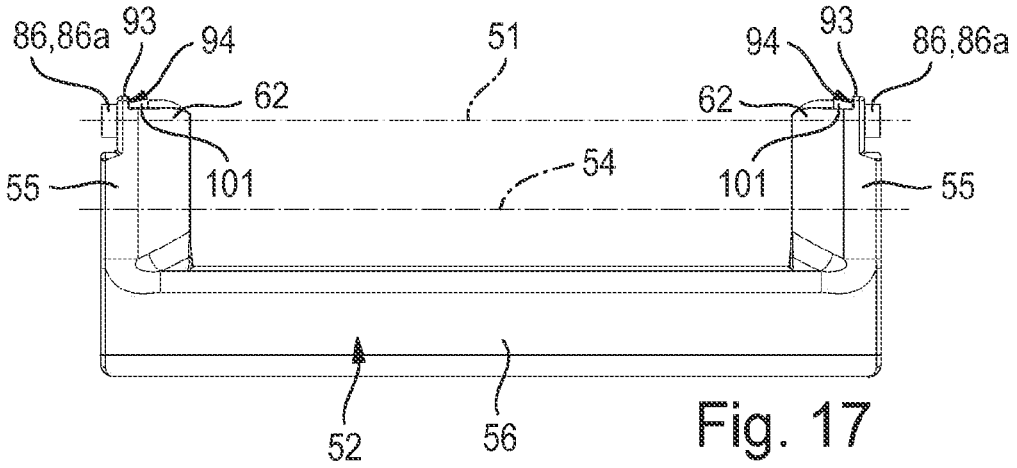
Figure 18:
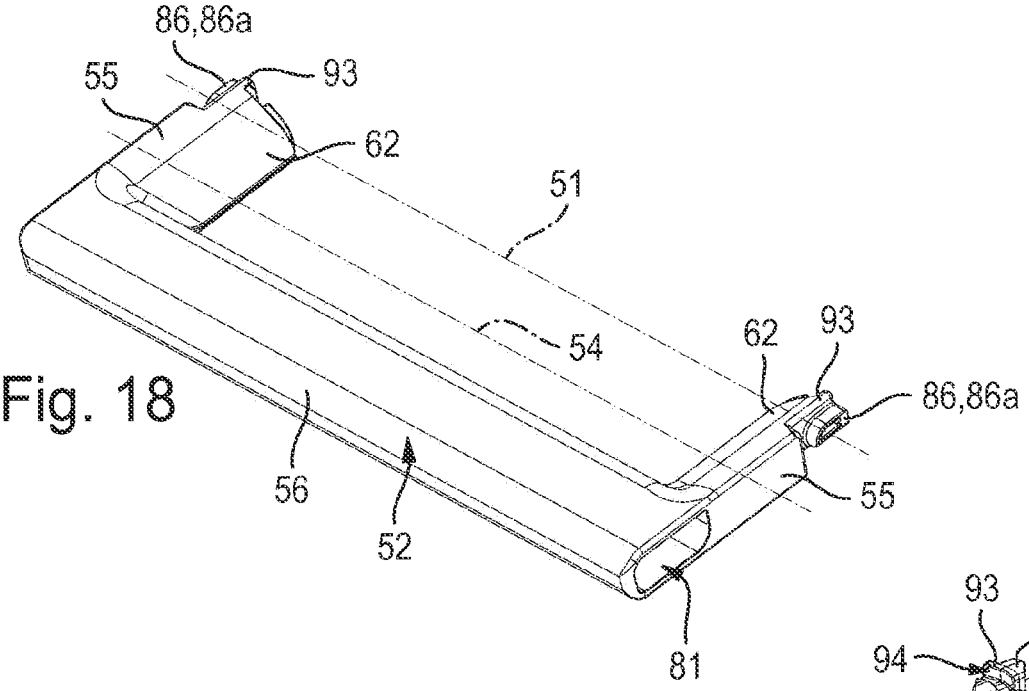
Figure 19:
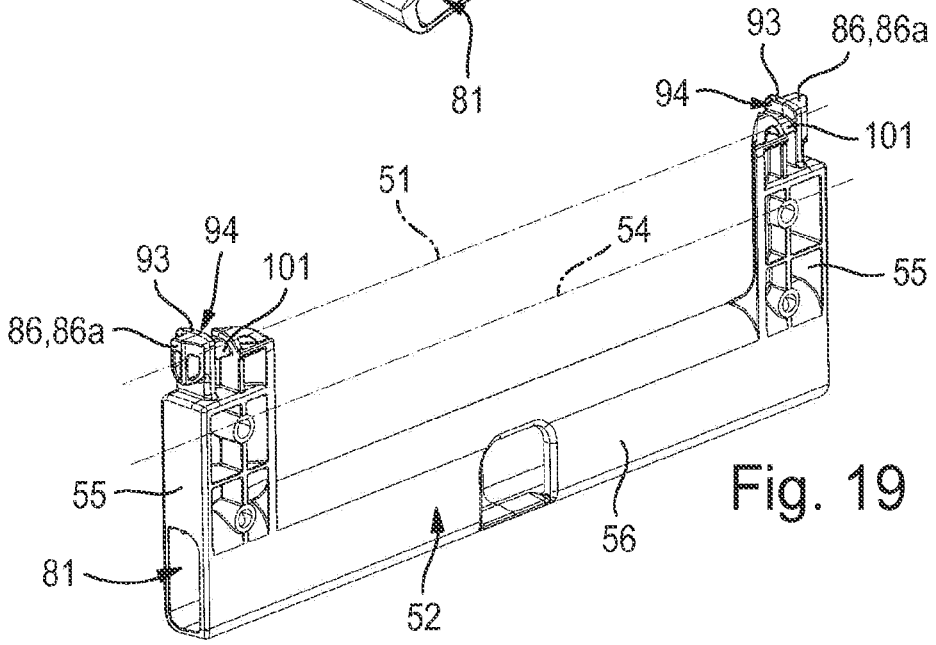

The front handle 52 is shown in the disassembled state in FIG. 15. Double arrows 96 indicate the possible relative movements of the two grip limbs 55 in the grip plane of the front handle 52 given an elastic bending of the front handle 52. For the assembly on the container housing 15, the front handle 52 is held in a relative position to the container housing 15 which corresponds to a pivoting position, in which the securing devices 91 are inactive. Concerning the embodiment example, this is a relative position which corresponds to the position of non-use 52*a*.

In this alignment, the front handle 52 is pressed with an assembly movement which is indicated by arrows 97, in the longitudinal direction 17 against the front wall 32 of the container housing 15, so that the second bearing elements 86 latch into the first bearing elements 85 in the course of a latching procedure.

Concerning the embodiment example, this latching procedure is rendered possible by way of each bearing pin 86*a* at the face side having an oblique sliding surface 99, with which given the assembly movement 97 it can slide on a peripheral edging structure 100 of the container housing 15 which encompasses the bearing eye 85*a*. By way of this sliding, the two grip limbs 55 are briefly moved to one another according to the arrows 96 amid elastic deformation, in order, after passing the peripheral edging structure 100, to move away from one another again according to the arrows 96 and to herein snap into the bearing eyes 85*a*.

When required, the front handle 52 can be very easily disassembled again by way of engaging with a lever tool into the gap between a grip limb 55 and the lateral edge surface 67, and the assigned grip limb 55 being elastically bent in the direction of the U-opening.

Expediently, the second support projection 93 delimits a first groove 101 which is formed at the face side on the free end section 62 of the grip limb 55 and is open transversely to the pivot axis 51. The first support projection 92 which is formed on the container housing 15 immerses into this first groove 101.

Additionally or alternatively, the first support projection 92 which is formed on the container housing 15 delimits a second groove 102 which is likewise open transversely to the pivot axis 91 and into which the second support projection 93 immerses. The immersing of the support projections 92, 93 into the grooves 102, 101 is effected selectively to the same extent as the mutual supporting effect of the two support projections 92, 93. An even better supporting and/or guidance of the grip limbs 55 results due to the grooves 101, 102.

Figure 3:
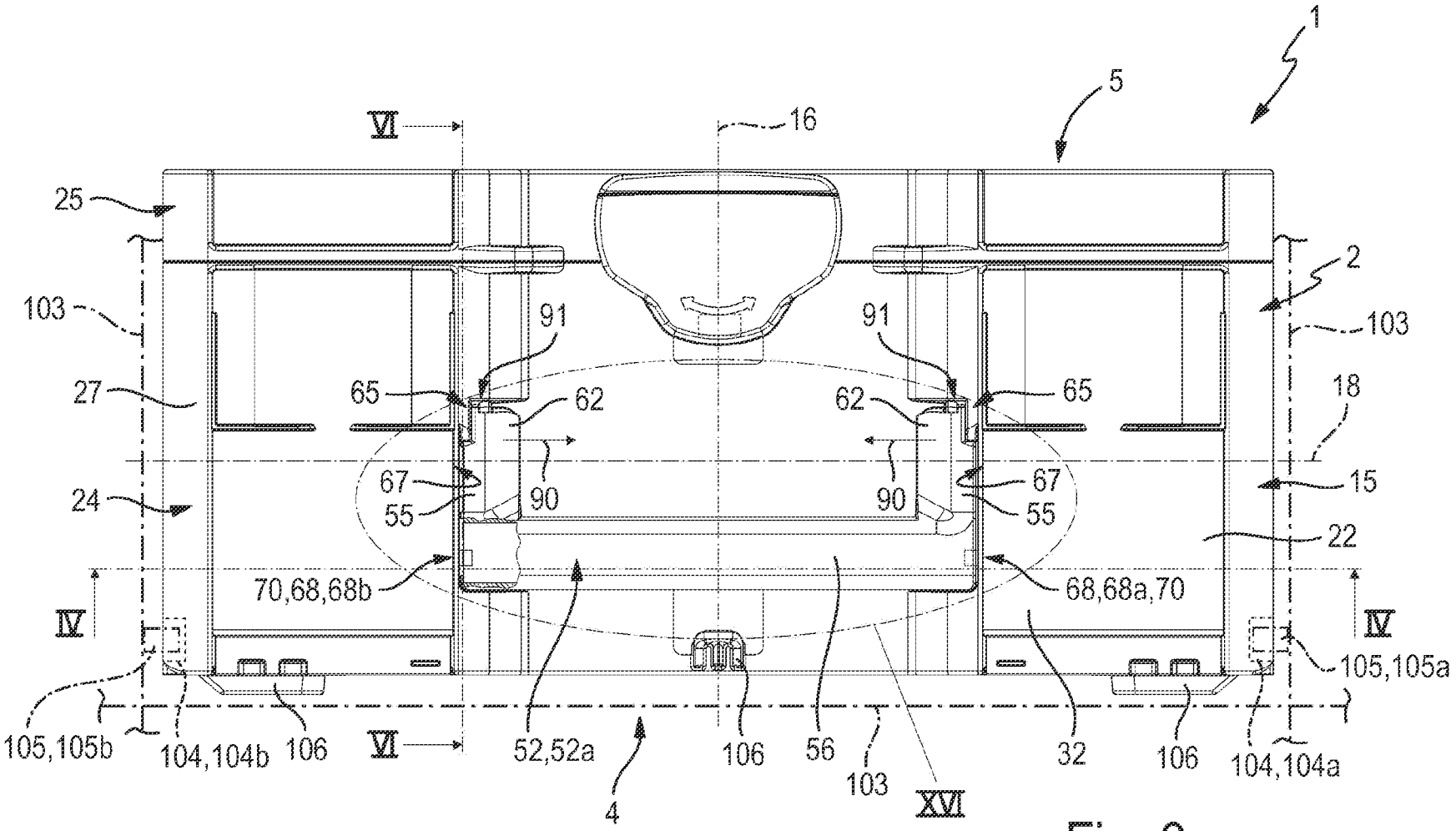

An advantageous design of the storage device 1 comprises a shelf structure 103 which is merely indicted in a schematic dot-dashed manner in FIG. 3 and which is designed in order to store at least one storage container 2 whilst not in use. The shelf structure 103 provides the possibility of receiving the at least one storage container 2 in a manner in which it can be pulled out in the manner of a drawer. Such a shelf structure 103 can be installed for example in a workshop or in a service vehicle.

In this context, the storage container 2 at the outer side of the housing lower part 24 comprises a guide device 104, via which it can be brought in a linearly displaceable manner into engagement in a releasable manner by way of a counter guide device 105 of the storage device 1 which is arranged on the shelf structure 103. By way of example, the guide device 104 comprises a guide rail 104*a*, 104*b* on the outer side of each side wall 34 in the region of the lower side 4. The counter guide device 105 has two counter guide rails 105*a*, 105*b* which are arranged distanced to one another on the shelf structure 103 in a manner such that the storage container 2 can be brought into engagement with them from the face side by way of its guide rails 104*a*, 104*b*.

The guide rails 104*a*, 104*b* and the counter guide rails 105*a*, 105*b* are matched to one another such that the storage container 2 can be inserted into the shelf structure 103 and can be pulled out of the shelf structure 103 in its longitudinal direction 17. The front handle 52 can be used for this handling.

The guide device 104 is expediently integrated as one piece into the housing lower part 24 which consists of plastic material.

Preferably, several storage containers 2 are stackable onto one another in the height direction 16, so that a container stack 98 results from two or more storage containers 2 which are stacked upon one another, as is shown by way of example in FIG. 20. In the stacked state, a respective upper container 2 is seated with its lower side 4 on the upper side 5 of a further container 2 which is arranged therebelow.

Expediently, each storage container 2 in the region of its lower side 4 has a lower coupling device 106 which is designed for example in a manner which is evident from FIG. 3. Furthermore, each storage container 2 on the upper side 5 has an upper coupling device 107 whose preferred design is evident from FIG. 1. The two coupling devices 106, 107 are adapted to one another such that on account of their interaction the storage containers 2 which are directed stacked on one another can be releasably coupled to one another in a manner in which they cannot be lifted from one another. Such a coupled state is shown in FIG. 20. The container stack 98 can then be carried and transported as a unit by way of the upper handle 45 of the uppermost storage container 2.

The locking means 38 which are explained further above preferably belong at least partly to the two coupling devices 106, 107. By way of example, the rotary bar 22 can be rotated into a coupling position which is shown in FIG. 20 at 108 and in which it couples the two storage containers 2 which are stacked onto one another, to one another in a non-liftable manner in the region of the front side 6.

Further constituents of the coupling devices 106, 107 with regard to the illustrated embodiment example are formed by projections which are formed on the lower side 4 and deepenings which are formed on the upper side 5. In the state of two storage containers 2 stacked onto one another, the projections and deepenings at least partly engage into one another, wherein they overlap or engage behind one another transversely to the height direction 16 and likewise effect a coupling of two storage containers 2 which are stacked onto one another, in a manner such that they cannot be lifted from one another, in particular in the region of the rear side 7. The projections are expediently stand feet which serve for placing the storage container 2 on a base.

The invention claimed is:

1. A storage device with at least one storage container which comprises a container housing, on which at the outside at least one handle is arranged, said handle being designed as an at least essentially U-shaped bow grip comprising two grip limbs which are connected to one another by a connection web, around which a hand can grip, and said handle in the region of the free end sections of the grip limbs, which are opposite the connection web, being mounted pivotably about a pivot axis via a pivot bearing device on the container housing so that the handle is pivotable between a position of non-use in which it is pivoted onto the container housing and a position of use in which it projects away from the container housing, wherein each pivot bearing device comprises a first bearing element which is arranged on the container housing and a second bearing element which is arranged on one of the grip limbs of the handle, said bearing elements being inserted into one another in the axis direction of the pivot axis and being rotatable relative to one another with respect to the pivot axis, wherein a securing device which assumes an active state at least in the position of use of the handle is assigned to the free end section of each grip limb, by way of which securing device in its active state the assigned grip limb is supported with respect to the container housing in the axis direction of the pivot axis, in order to prevent a mutual approach of the two grip limbs which would permit a release from one another of the bearing elements which are inserted into one another.

2. The storage device according to claim 1, wherein the two bearing elements of each pivot bearing device on assembly of the handle are inserted into one another by way of a latching procedure which is entailed by an elastic bending of the handle amid the mutual approach of the two grip limbs, wherein each securing device in at least one other pivoting position of the handle which is different from the position of use assumes an inactive state, in which it releases the grip limb which is assigned to it, in order to permit a relative movement between the two grip limbs directed towards one another in the axis direction of the pivot axis, said relative movement being necessary for the latching procedure.

3. The storage device according to claim 2, wherein the inactive state of the securing devices is present at least in the region of the position of non-use of the handle.

4. The storage device according to claim 3, wherein the inactive state of the securing devices is present exclusively in the region of the position of non-use of the handle.

5. The storage device according to claim 2, wherein the inactive state of the securing devices is present in the position of non-use as well as in a pivoting region of the handle of maximally 10 degrees, said pivoting region following the position of non-use.

6. The storage device according to claim 1, wherein, of the two bearing elements of each pivot bearing device, the one bearing element is designed as a bearing eye and the other bearing element as a bearing pin which is rotatably inserted into the bearing eye.

7. The storage device according to claim 6, wherein the two bearing elements of each pivot bearing device on assembly of the handle are inserted into one another by way of a latching procedure, which is entailed by an elastic bending of the handle amid the mutual approach of the two grip limbs, wherein each securing device in at least one other pivoting position of the handle which is different from the position of use assumes an inactive state, in which it releases the grip limb which is assigned to it, in order to permit a relative movement between the two grip limbs directed towards one another in the axis direction of the pivot axis, said relative movement being necessary for the latching procedure, and wherein each bearing pin at the face side has an oblique sliding surface, with which it can slide on a peripheral edging structure of the container housing which encompasses the bearing eye, whilst creating an elastic bending of the handle, when the handle, during the latching procedure, executes an assembly movement which is at right angles to the pivot axis and is orientated towards the container housing.

8. The storage device according to claim 6, wherein the first bearing elements which are arranged on the container housing are designed as bearing eyes with insert openings which face one another and the second bearing elements which are arranged on the grip limbs are designed as bearing pins which point away from one another.

9. The storage device according to claim 1, wherein the pivot bearing devices are arranged in the region of the outer sides of the two grip limbs which are facing away from one another in the axis direction of the pivoting axis.

10. The storage device according to claim 1, wherein the pivot bearing devices are arranged in the region of two lateral edge surfaces of an outer wall deepening of the housing wall of the container housing which lie opposite one another at a distance, in a manner such that the handle is received in the outer wall deepening in a completely sunk manner in its position of non-use and projects out of the wall deepening in its position of use.

11. The storage device according to claim 1, wherein each securing device comprises a first support projection which is arranged on the container housing in the region of the pivot axis of the handle and which projects away from a housing wall of the container housing transversely to the pivot axis as well as a second support projection which is arranged on the free end section of the assigned grip limb and participates in the pivoting movement of the assigned grip limb, wherein the second support projection is arranged offset to the first support projection in the axis direction of the pivot axis in the direction of the outer side of the grip limb and is designed in a manner such that an overlapping at right angles to the pivot axis of the handle is present between the first support projection and the second support projection in the active state of the securing device.

12. The storage device according to claim 11, wherein the two bearing elements of each pivot bearing device on assembly of the handle are inserted into one another by way of a latching procedure which is entailed by an elastic bending of the handle amid the mutual approach of the two grip limbs, wherein each securing device in at least one other pivoting position of the handle which is different from the position of use assumes an inactive state, in which it releases the grip limb which is assigned to it, in order to permit a relative movement between the two grip limbs directed towards one another in the axis direction of the pivot axis, said relative movement being necessary for the latching procedure, and wherein no overlapping at right angles to the pivot axis of the handle is present between the first support projection and the second support projection in the inactive state of the securing device.

13. The storage device according to claim 12, wherein the first support projection and/or the second support projection delimits a groove which is open at right angles to the pivot axis and into which the respective other support projection either immerses or does not immerse depending on the pivoting position of the handle.

14. The storage device according to claim 1, wherein the storage container comprises an arresting device which is assigned to the handle and which is designed for the non-pivotable releasable arresting of the handle in its position of non-use.

15. The storage device according claim 14, wherein the arresting device is designed as a latching device which with a snap effect automatically latches in or latches during the pivoting of the handle which is caused by a manual introduction of force.

16. The storage device according to claim 1, wherein the container housing of the storage container has an upper side which faces in a height direction as well as a front side which is orientated at right angles to the height direction, wherein the handle which is provided with the securing devices is a front handle which is pivotably arranged on the front side of the container housing and whose pivot axis runs at right angle to the height direction of the container housing.

17. The storage device according to claim 16, wherein the container housing additionally to the front handle which is arranged on the front side comprises an upper handle which is arranged on the upper side.

18. The storage container according to claim 17, wherein the upper handle is pivotably mounted on the container housing, wherein in the course of a pivoting movement it is selectively pivotable into a position of non-use in which it is pivoted onto the container housing or into a position of use in which it is pivoted away from the container housing and projects upwards.

19. The storage device according to claim 18, wherein the storage container comprises an upper arresting device which is assigned to the upper handle and is for the releasable arresting of the upper handle in its position of non-use.

20. The storage device according to claim 19, wherein the upper arresting device is designed as a latching device.

21. The storage device according to claim 17, wherein the container housing has a box-like housing lower part which on an upper side which faces upwards in the height direction comprises an access opening for a storage space, and a housing lid which is assigned to the access opening and for opening and closing the access opening is pivotably mounted on the housing lower part, wherein the upper handle is arranged on the housing lid at the top on the outside and the front handle is arranged at the outside on a front wall of the housing lower part which projects upwards from a base wall of the housing lower part.

22. The storage device according to claim 1, wherein the storage container on the outer side of the container housing comprises a guide device, via which it can be received in a shelf structure in a manner in which it can be pulled out.

23. A storage device according to claim 1, further comprising several storage containers which each on their container housing in the region of the lower side comprise a lower coupling device and in the region of the upper side comprise an upper coupling device, wherein these two coupling devices are adapted to one another in a manner such that storage containers which are directly stacked onto one another in the height direction, by way of the interaction of the upper coupling device of the respective lower storage container and of the lower coupling device of the respective upper storage container can be releasably coupled to one another in a manner in which they cannot be lifted from one another.

24. The storage device according to claim 1, wherein each securing device in at least one pivoting position of the handle, which is different from the position of use, assumes an inactive state in which the associated grip limb is released for permitting a relative movement between the two grip limbs directed towards one another in the axis direction of the pivot axis.

* * * * *